US009689221B2

(12) United States Patent
Harms et al.

(10) Patent No.: US 9,689,221 B2
(45) **Date of Patent: *Jun. 27, 2017**

(54) PACKER SETTING TOOL

(71) Applicant: HALLIBURTON ENERGY SERVICES, INC., Houston, TX (US)

(72) Inventors: Timothy Edward Harms, The Colony, TX (US); William Mark Richards, Flower Mound, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 720 days.

This patent is subject to a terminal disclaimer.

(21) Appl. No.: 14/050,336

(22) Filed: Oct. 9, 2013

(65) Prior Publication Data

US 2014/0151070 A1 Jun. 5, 2014

Related U.S. Application Data

(63) Continuation of application No. PCT/US2012/067697, filed on Dec. 4, 2012.

(51) Int. Cl.
*E21B 23/06* (2006.01)

(52) U.S. Cl.
CPC ..... *E21B 23/06* (2013.01)

(58) Field of Classification Search
CPC ..... E21B 23/06
See application file for complete search history.

(56) References Cited

U.S. PATENT DOCUMENTS

| | | | | |
|---|---|---|---|---|
| 8,066,069 | B2 | 11/2011 | Giroux et al. | |
| 8,783,340 | B2 | 7/2014 | Harms et al. | |
| 2004/0112597 | A1 | 6/2004 | Hamid et al. | |
| 2010/0012330 | A1 | 1/2010 | Ezell et al. | |
| 2011/0240295 | A1 | 10/2011 | Porter et al. | |
| 2012/0145378 | A1 | 6/2012 | Frazier | |
| 2013/0056200 | A1* | 3/2013 | Martinez | E21B 47/06 166/250.04 |
| 2013/0255943 | A1 | 10/2013 | Yeh et al. | |

FOREIGN PATENT DOCUMENTS

| | | | |
|---|---|---|---|
| WO | 2011079169 | A2 | 6/2011 |
| WO | 2014088550 | A1 | 6/2014 |

OTHER PUBLICATIONS

Harms, Timothy Edward, Patent Application entitled "Packer Setting Tool", filed Oct. 9, 2013, U.S. Appl. No. 14/110,922.
FAIPP Pre-Communication dated Dec. 20, 2013, filed Oct. 9, 2013, U.S. Appl. No. 14/110,922.

(Continued)

*Primary Examiner* — Nicole Coy
(74) *Attorney, Agent, or Firm* — Scott Richardson; Baker Botts L.L.P.

(57) ABSTRACT

A setting tool comprises a centralizer section, a latching section configured to selectively engage the packer, and a setting section configured to provide a setting force to the packer through the setting sleeve. The centralizer section is configured to centralize a setting sleeve within a packer, and the centralizer section is configured to control the rate at which the setting sleeve engages the packer.

19 Claims, 29 Drawing Sheets

(56) References Cited

OTHER PUBLICATIONS

FAIPP Office Action dated Feb. 6, 2014, filed Oct. 9, 2013, U.S. Appl. No. 14/110,922.
Foreign Communication from a Related Counterpart Application, "International Search Report and Written Opinion" dated Aug. 20, 2013, International Application No. PCT/US12/67697 filed on Dec. 4, 2012.
Notice of Allowance dated Apr. 17, 2014, filed Oct. 9, 2013, U.S. Appl. No. 14/110,922.

* cited by examiner

PACKER SETTING TOOL

CROSS-REFERENCE TO RELATED APPLICATIONS

This application is a continuation of and claims priority under 35 U.S.C. §120 to International Patent Application Serial No. PCT/US12/67697, filed on Dec. 4, 2012, entitled "Packer Setting Tool," by Timothy Edward Harms, et al., which is incorporated herein by reference for all purposes.

STATEMENT REGARDING FEDERALLY SPONSORED RESEARCH OR DEVELOPMENT

Not applicable.

REFERENCE TO A MICROFICHE APPENDIX

Not applicable.

BACKGROUND

The present disclosure relates generally to an apparatus utilized in subterranean wells and, in a preferred embodiment thereof, more particularly provides a packer setting/re-setting tool. Completion of oil wells with sand control screens in an open hole is a method to complete a reservoir section. In general the completion string comprising screens, production sleeves, and various other components may be lowered into the wellbore and positioned at the desired location adjacent a producing formation. The completion string may be maintained in position using a hanger and/or a packer, which may generally be located at or near the top end of the completion string section. The hanger and/or packer may be set in any conventional manner. In circumstances in which the hanger and/or packer are not set according to the desired specifications, the entire string may be retrieved, repaired, and replaced within the wellbore.

SUMMARY

In an embodiment, a setting tool comprises a slow stroke mandrel configured for engagement with an inner mandrel of a packer; a latching member configured to provide a releasable engagement between the setting tool mandrel and the inner mandrel of the packer; a centralizing member, wherein the centralizing member is slidingly disposed about the setting tool mandrel; a collet coupled to the centralizing member, wherein the collet is configured to engage the slow stroke mandrel; a driving member comprising a piston, wherein the piston is coupled to the centralizing member; a setting sleeve coupled to the centralizing member, wherein the setting sleeve is configured to engage a packer setting sleeve shoulder of the packer. The engagement between the collet and the slow stroke mandrel is configured to control the stroke speed of the setting sleeve when the piston is selectively energized.

In an embodiment, a setting tool comprises a centralizer section, a latching section configured to selectively engage the packer, and a setting section configured to provide a setting force to the packer through the setting sleeve. The centralizer section is configured to centralize a setting sleeve within a packer, and the centralizer section is configured to control the rate at which the setting sleeve engages the packer.

In an embodiment, a method for setting a packer in a wellbore comprises positioning a setting tool in a wellbore adjacent a packer, engaging the setting tool mandrel within the packer setting sleeve, centralizing the setting tool mandrel within the packer setting sleeve, incrementally driving the setting sleeve into engagement with the packer setting sleeve, and applying a setting force to the packer setting sleeve through the setting sleeve. The packer comprises the packer setting sleeve, and the setting tool comprises the setting sleeve disposed about a setting tool mandrel.

These and other features will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
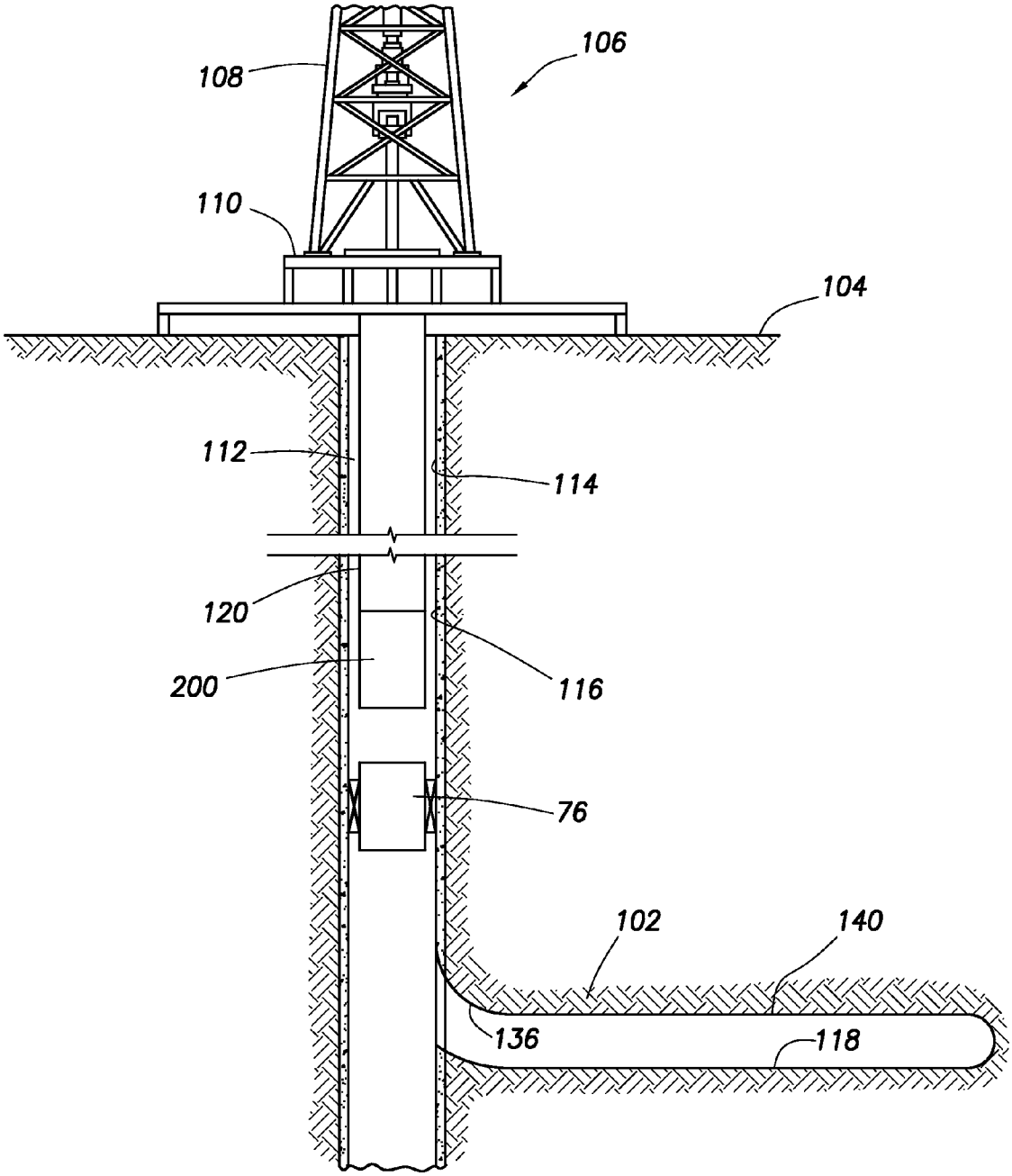
FIG. 1 is a cut-away view of an embodiment of a wellbore servicing system according to an embodiment.

In the drawings and description that follow, like parts are typically marked throughout the specification and drawings with the same reference numerals, respectively. The drawing figures are not necessarily to scale. Certain features of the present device may be shown exaggerated in scale or in somewhat schematic form and some details of conventional elements may not be shown in the interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "above" meaning toward the surface of the wellbore and with "down," "lower," "downward," or "below" meaning toward the terminal end of the well, regardless of the wellbore orientation. Reference to in or out will be made for purposes of description with "in," "inner," or "inward" meaning toward the center or central axis of the wellbore, and with "out,"

"outer," or "outward" meaning toward the wellbore tubular and/or wall of the wellbore. Reference to "longitudinal," "longitudinally," or "axially" means a direction substantially aligned with the main axis of the wellbore and/or wellbore tubular. Reference to "radial" or "radially" means a direction substantially aligned with a line between the main axis of the wellbore and/or wellbore tubular and the wellbore wall that is substantially normal to the main axis of the wellbore and/or wellbore tubular, though the radial direction does not have to pass through the central axis of the wellbore and/or wellbore tubular. The various characteristics mentioned above, as well as other features and characteristics described in more detail below, will be readily apparent to those skilled in the art with the aid of this disclosure upon reading the following detailed description of the embodiments, and by referring to the accompanying drawings. Further, combinations of the embodiments disclosed herein are also contemplated by this disclosure.

In some circumstances, a packer may be incompletely set in a wellbore, which may be referred to in some contexts as being partially set. A partially set packer may be problematic and result in some leakage between the packer and the wellbore and/or supply only a partial retaining force applied across the packer. Such an incomplete setting may be due to various causes such as the failure to apply the full actuation force to the packer and/or premature shearing of packer elements to release the actuation force. When a packer is incompletely set, the packer and any associated completion components may be removed from the wellbore and then replaced or repaired before being redisposed in the wellbore and reset. Such operations are costly and time consuming The present disclosure teaches a packer setting tool that can engage a packer such as a partially set packer within the wellbore, and apply the appropriate setting force to fully set the packer.

The packer setting tool of the present disclosures is configured to engage a packer such as a sand control packer that has either not yet been set in the wellbore or that has been set, but the setting process was not complete. To set a packer using the packer setting tool, the packer setting tool is placed in the wellbore and advanced toward the location of the packer. Once at the packer, the packer setting tool locates the setting sleeve of the packer and centralizes the setting sleeve within the packer. The packer setting tool may then engage with the packer to prevent axial movement. A piston can then controllably drive a slow stroke mandrel configured to control the stroke of the piston and thus control the speed by which the various elements engage. The control of the setting speed may limit and/or prevent damage to the packer when the packer is either set or reset.

In general, packers are coupled to the setting mechanism before being run into the wellbore, which allows the setting portions to be engaged at the surface. During the setting process, the packer engages the wellbore to anchor and seal. The setting process can be interrupted (such as a setting tool malfunction) which may result in an incomplete set of the packer. A packer may become damaged if the setting tool tries to reattach to the packer. An improperly aligned setting tool can result in damage of the engaging surfaces, which may prevent the proper engagement of the packer setting tool with the packer. Several features of the present packer setting tool may aid in engaging the packer setting tool with the packer to prevent such damage. First, the slow stroke mandrel may limit the engagement rate of a setting sleeve with a setting shoulder (e.g., a no-go shoulder) within the packer. While various embodiments are envisioned, the slow stroke mandrel may comprise a circumferentially grooved mandrel, and a collet coupled to the setting sleeve may engage the grooved mandrel. The collet may have collet lugs that engaged the grooves and require a force to be driven over and past each groove. This engagement may result in a step-wise motion along the grooved mandrel, which may serve to slow the action of the setting mandrel relative to the setting shoulder on the packer. Thus, the setting sleeve may slowly approach the packer and avoid or limit any damage to the packer and/or the setting sleeve. Second, the setting sleeve may have a small tolerance with respect to the alignment with the packer. In order to properly align the engaging components, a centralizing member may be coupled to the setting sleeve and move with the setting sleeve. The centralizing member may be used to align the packer setting tool with the packer so that the setting sleeve may properly align with the setting shoulder of the packer as the two parts approach and engage each other.

Once the packer setting tool is engaged with the packer, pressure may be applied to a piston within the packer setting tool to provide a suitable setting force to the packer through the setting shoulder on the packer. The force may be sufficient to fully set the packer. Once the packer is set, the setting tool may then be released from the packer by twisting the packer setting tool in a direction opposite the threading direction of the remaining components forming the wellbore tubular string. This may allow the other tools located in the wellbore remain properly threaded together. Thus, the packer setting tool allows an operator to set the packer properly, if the packer was not set properly a previous time, without having to remove an entire system in a wellbore. Because of these features this setting tool could save several days of work if the packer is not initially set properly. While described in terms of a packer, the setting tool described herein may be used with any mechanically set tool that is not set or not fully set.

Referring to FIG. 1, an example of a wellbore operating environment is shown. As depicted, the operating environment comprises a drilling rig 106 that is positioned on the earth's surface 104 and extends over and around a wellbore 114 that penetrates a subterranean formation 102 for the purpose of recovering hydrocarbons. The wellbore 114 may be drilled into the subterranean formation 102 using any suitable drilling technique. The wellbore 114 extends substantially vertically away from the earth's surface 104 over a vertical wellbore portion 116, deviates from vertical relative to the earth's surface 104 over a deviated wellbore portion 136, and transitions to a horizontal wellbore portion 118. In alternative operating environments, all or portions of a wellbore may be vertical, deviated at any suitable angle, horizontal, and/or curved. The wellbore may be a new wellbore, an existing wellbore, a straight wellbore, an extended reach wellbore, a sidetracked wellbore, a multilateral wellbore, and other types of wellbores for drilling and completing one or more production zones. Further the wellbore may be used for both producing wells and injection wells. In an embodiment, the wellbore may be used for purposes other than or in addition to hydrocarbon production, such as uses related to geothermal energy.

A wellbore tubular string 120 comprising a packer setting tool 200 may be lowered into the subterranean formation 102 for a variety of workover or treatment procedures throughout the life of the wellbore. The embodiment shown in FIG. 1 illustrates the wellbore tubular 120 in the form of a tubing string being lowered into the subterranean formation. It should be understood that the wellbore tubular 120 comprising a packer setting tool 200 is equally applicable to any type of wellbore tubular being inserted into a wellbore, including as non-limiting examples drill pipe, production tubing, rod strings, and/or coiled tubing. The packer setting tool 200 may also be used to set and/or reset various other tools such as hangers, plugs, annular safety valves, and any other component using a compression force for actuation.

The drilling rig 106 comprises a derrick 108 with a rig floor 110 through which the wellbore tubular 120 extends downward from the drilling rig 106 into the wellbore 114. The drilling rig 106 comprises a motor driven winch and other associated equipment for extending the wellbore tubular 120 into the wellbore 114 to position the wellbore tubular 120 at a selected depth. While the operating environment depicted in FIG. 1 refers to a stationary drilling rig 106 for lowering and setting the wellbore tubular 120 comprising the packer setting tool 200 within a land-based wellbore 114, in alternative embodiments, mobile workover rigs, wellbore servicing units (such as coiled tubing units), and the like may be used to lower the wellbore tubular 120 comprising the packer setting tool 200 into a wellbore. It should be understood that a wellbore tubular 120 comprising the packer setting tool 200 may alternatively be used in other operational environments, such as within an offshore wellbore operational environment.

In alternative operating environments, a vertical, deviated, or horizontal wellbore portion may be cased and cemented and/or portions of the wellbore may be uncased. For example, uncased section 140 may comprise a section of the wellbore 114 ready for being cased with wellbore tubular 120. In an embodiment, a packer setting tool 200 may be used on production tubing in a cased or uncased wellbore. In an embodiment, a portion of the wellbore 114 may comprise an underreamed section. As used herein, underreaming refers to the enlargement of an existing wellbore below an existing section, which may be cased in some embodiments. An underreamed section may have a larger diameter than a section above the underreamed section. Thus, a wellbore tubular passing down through the wellbore may pass through a smaller diameter passage followed by a larger diameter passage.

Figure 2A:
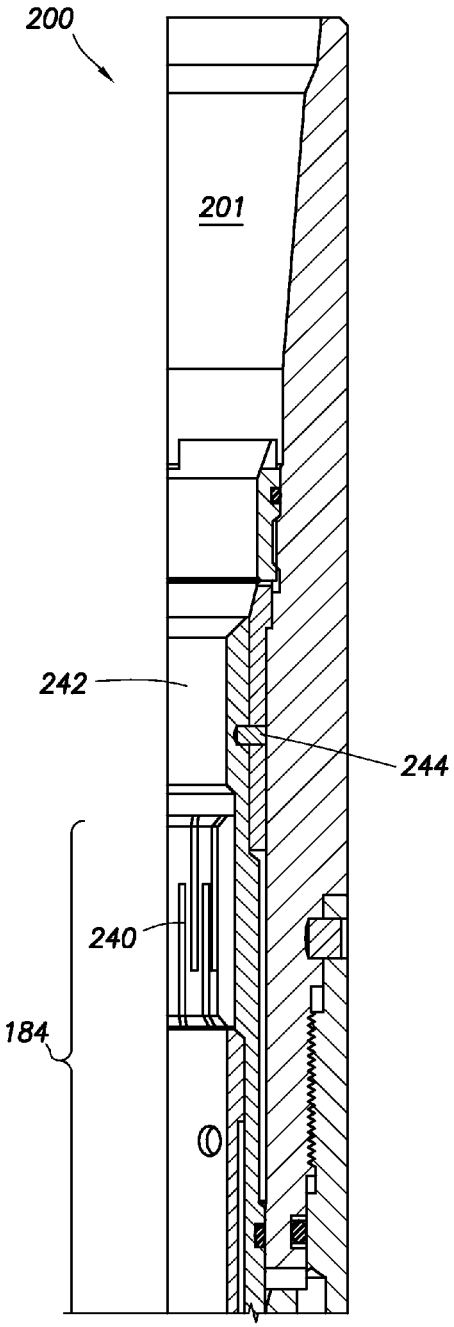
FIG. 2A-2I is a cross-section view of an embodiment of a packer setting tool engaging a packer.
Figure 2B:
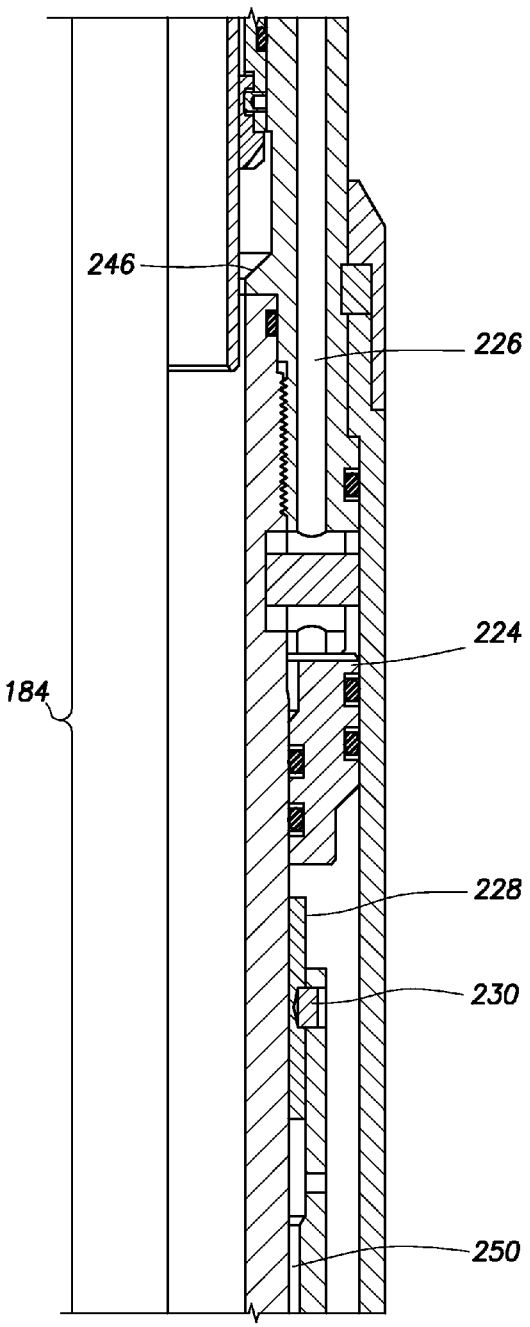
Figure 2C:
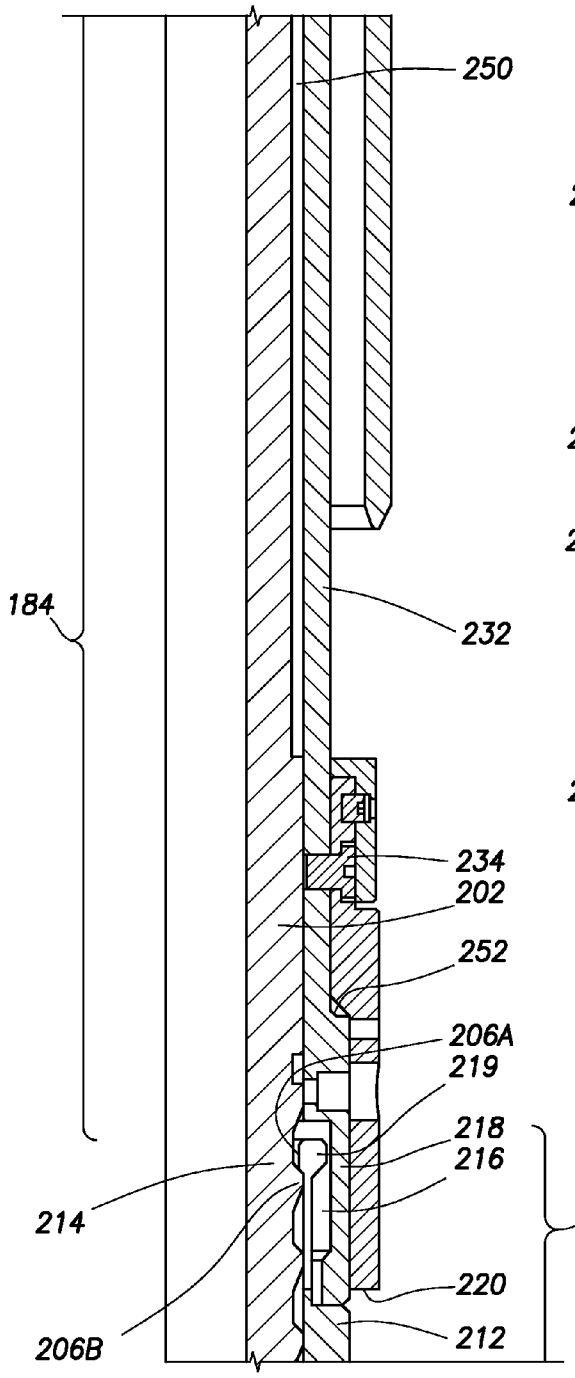

Regardless of the type of operational environment the packer setting tool 200 is used, it will be appreciated that the packer setting tool 200 serves to set and/or reset a packer 76 in a wellbore 114. An embodiment of a packer setting tool 200 which embodies principles of the present device is illustrated in FIGS. 2A-2I. As depicted, the packer setting tool 200 may comprise a latching section 180 (FIGS. 2E and 2F), a centralizing section 182 (FIGS. 2C and 2D), and a setting section 184 (FIGS. 2A-2C). The centralizing section 182 may be configured to locate the packer within a wellbore and for centralizing a packer setting sleeve 92 within a packer. The centralizing section 182 may allow the packer setting tool 200 to align with the end of the packer being engaged for setting and/or resetting. The latching section 180 may be configured to selectively engage the packer 76. The setting section 184 may be configured to drive the packer 76 into sealing engagement with the wellbore (e.g., fully setting the packer). The centralizing section 182 may be configured to control the rate at which the setting sleeve engages the packer, and thereby controls the speed at which the packer is driven into sealing engagement with the wellbore.

Figure 2D:
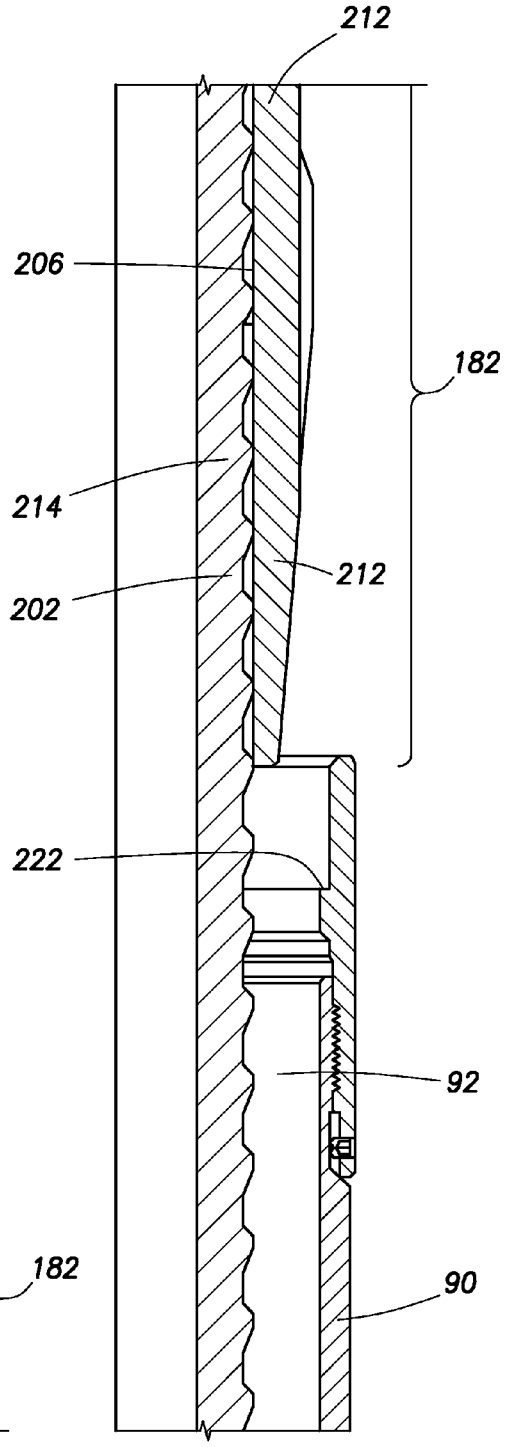
Figure 2E:
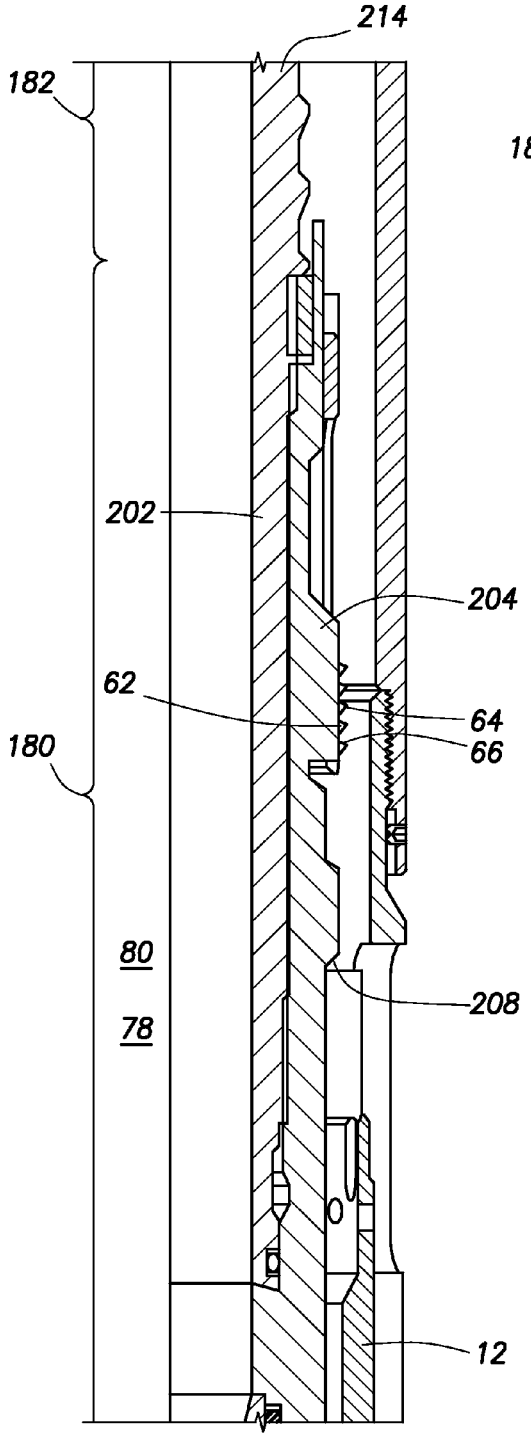
Figure 2F:
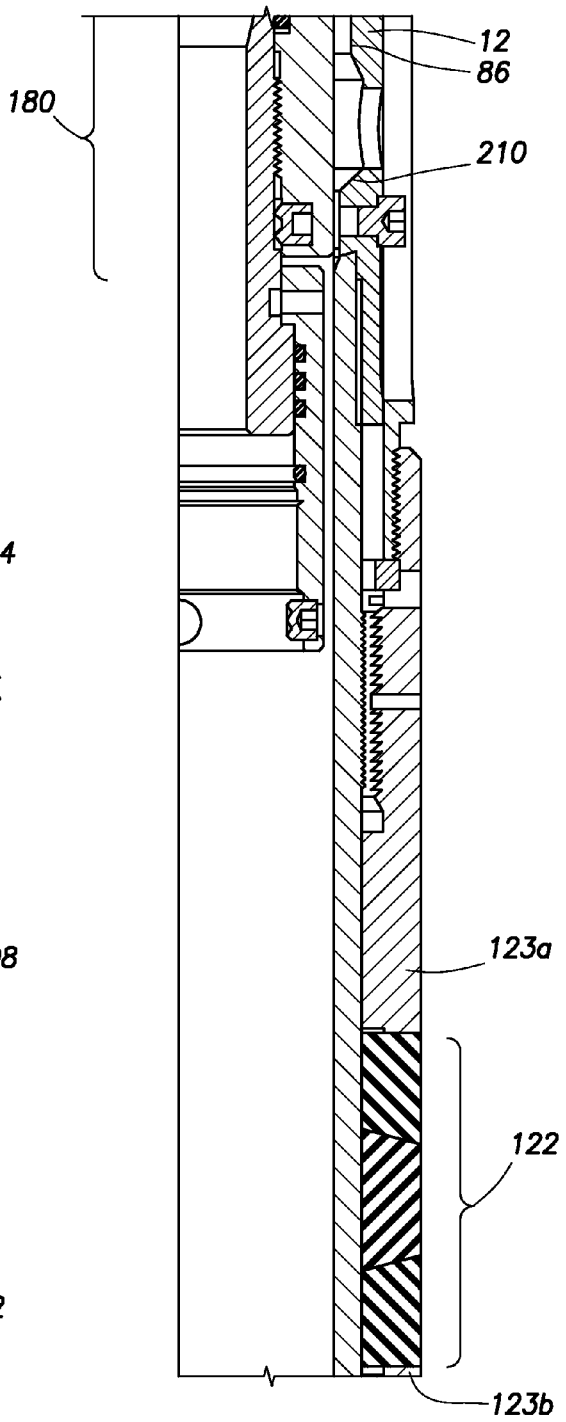

In an embodiment, the packer setting tool 200 may also comprise a latching member 204 (FIG. 2E) fixedly attached to a setting tool mandrel 202 (FIG. 2C) and configured to axially engage the top sub 12 (FIG. 2F) of the packer 76. Threads 62 (FIG. 2E) are disposed about the latching member 204. For purposes that will become apparent upon consideration of the further detailed description hereinbelow, the threads 62 may comprise left-handed threads. Further, the threads 62 may have an inclined lower face 64 (FIG. 2E) and a flat upper face 66 (FIG. 2E). The lower faces 64 are, thus, similar to a series of axially spaced apart and circumferentially extended "ramps." Such thread type may also be referred to as "buttress" threads.

The packer setting tool 200 may further comprise a setting tool male no-go 208 configured to engage a packer female no-go 210. When the packer setting tool 200 is positioned for engagement with the packer 76, the setting tool mandrel 202 may be axially received in the setting sleeve 92 of the packer between the tubular inner mandrel 78 of the packer 76 and a packer setting sleeve 90. The setting tool mandrel 202 may displace relative to the setting sleeve 92 of the packer 76 until the setting tool male no-go 208 engages the packer female no-go 210 preventing the setting tool mandrel 202 from further displacement. As the setting tool mandrel 202 with the setting tool male no-go 208 advances toward the packer female no-go 210, threads 62 disposed on the latching member 204 may ratchet over threads 86 complementarily shaped relative to threads 62 on the setting tool mandrel 202 disposed on the top sub 12 of the packer 76. The threads 62 and 86 may allow for the threads 62 and 86 to ratchet over each other with the inclined lower faces 64 as the packer setting tool 200 axially engages with the packer 76. Additionally, the flat upper faces 66 may prevent reverse axially movement to separate the packer setting tool 200 and the packer 76.

After the setting tool male no-go 208 (FIG. 2E) engages the packer female no-go 210 (FIG. 2F), the latching member 204 may axially attach the packer setting tool 200 with the packer 76. When the packer setting tool 200 is ready for disengagement from the packer 76, the packer setting tool 200 may disengage via rotation that may be in the same direction used to couple other connections within the tubing string (e.g., clockwise rotation). In this manner, the packer setting tool 200 may be conveniently disengaged from the packer 76 by rotation of the upper tubing string at the earth's surface, without causing loosening of threaded connections in the tubing string.

In another embodiment, the latching member 204 may axially attach the packer setting tool 200 with the packer 76 using collet fingers which secure the packer setting tool 200 with the packer 76. The collet fingers may be locked in place with a shear ring preventing expansion of the fingers for release. When the packer setting tool 200 is ready for disengagement with the packer 76, a sufficient upward force applied on the packer setting tool 200 may cause the shear ring to shear, thereby permitting the collet fingers to be biased inward and out of engagement with the packer 76, which may permit the packer setting tool 200 to be disengaged from the packer 76. In yet another embodiment, the latching member 204 may axially disengage the packer setting tool 200 with the packer 76 using a fluid pressure and piston to pull a collet prop out from under a collet so that the collet can collapse.

The packer setting tool 200 may further include a centralizing member 212 (FIGS. 2C and 2D) slidingly engaged to the setting tool mandrel 202. The centralizing member 212 may be configured to centralize the packer setting tool 200 within the packer upon engagement so that a male centralizer member shoulder 220 (FIG. 2C) engages a female packer setting sleeve shoulder 222 (FIG. 2D). This feature may allow for reliable engagement between the packer setting tool 200 with the packer 76 so that packer setting tool 200 may drive the packer 76 into the set position in the wellbore 114. In an embodiment, the centralizing member 212 may comprise a fluted or splined sleeve configuration. This configuration may make insertion of the centralizing member 212 into the setting sleeve 92 more reliable while allowing for fluid flow around the centralizing member 212. For example, when the packer setting tool 200 is setting a sand control packer, the fluted sleeve design may create a close fit with the sand control packer allowing for a fluid by-pass or a debris by-pass in the sand control packer.

When the packer setting tool 200 is disposed in the wellbore 114 to set the packer 76, the packer setting tool 200 may be displaced through the wellbore 114 until it reaches the location of the packer 76. The centralizing member 212 may locate the packer setting sleeve 90 so that packer setting tool 200 can be engaged with the packer 76. Once the centralizing member 212 locates the packer 76, the packer setting tool may advance into engagement with the packer 76. As the packer setting tool 200 advances, the centralizing member 212 may engage the packer setting sleeve 90 and the tubular inner mandrel 78 of the packer 76 and may guide the packer 76 into radially alignment with the wellbore 114.

The packer setting tool 200 may also include a slow stroke mandrel 214 (FIG. 2C-2E) comprising a collet 216 (FIG. 2C) disposed in a collet housing 218 (FIG. 2C). The slow stroke mandrel 214 is integrated with the setting tool mandrel 202. In an embodiment, the slow stroke mandrel may be the portion of the setting tool mandrel 202 comprising the circumferential grooves 206. The collet lug 219 (FIG. 2C) at the distal end of the collet 216 may engage the circumferential grooves 206 (FIG. 2D) so that the engagement controls the stroke speed and thus the setting speed of the packer 76. This feature may help to reduce any hammering effect thus prevent damage to the packer setting sleeve 90, the setting sleeve shoulder 222, and the packer setting mechanism as a whole.

In general, a collet may comprise one or more springs (e.g., beam springs) and/or spring means separated by slots. In an embodiment, the slots may comprise longitudinal slots, angled slots, as measured with respect to the longitudinal axis, helical slots, and/or spiral slots for allowing at least some radial compression in response to a radially compressive force. A collet may generally be configured to allow for a limited amount of radial compression of the springs in response to a radially compressive force, and/or a limited amount of radial expansion of the springs in response to a radially expansive force. The collet 216 may also comprise a collet lug 219 disposed on a surface and/or end of the springs. In an embodiment, the collet 216 used with the packer setting tool 200 may be configured to allow for a limited amount of radial expansion of the springs and collet lug 219 in response to a radially expansive force. The radial expansion may allow the springs to contract into the circumferential grooves 206 while being able to expand to pass over the ridges separating the adjacent circumferential grooves 206. As depicted in FIGS. 2A-2H, when a force is exerted on the packer setting tool 200 to set the packer 76, that force must overcome the force required to displace the collet 216 over the longitudinal distance of at least one circumferential mandrel groove 206 (FIG. 2C) on the setting tool mandrel 202.

Figure 8A:
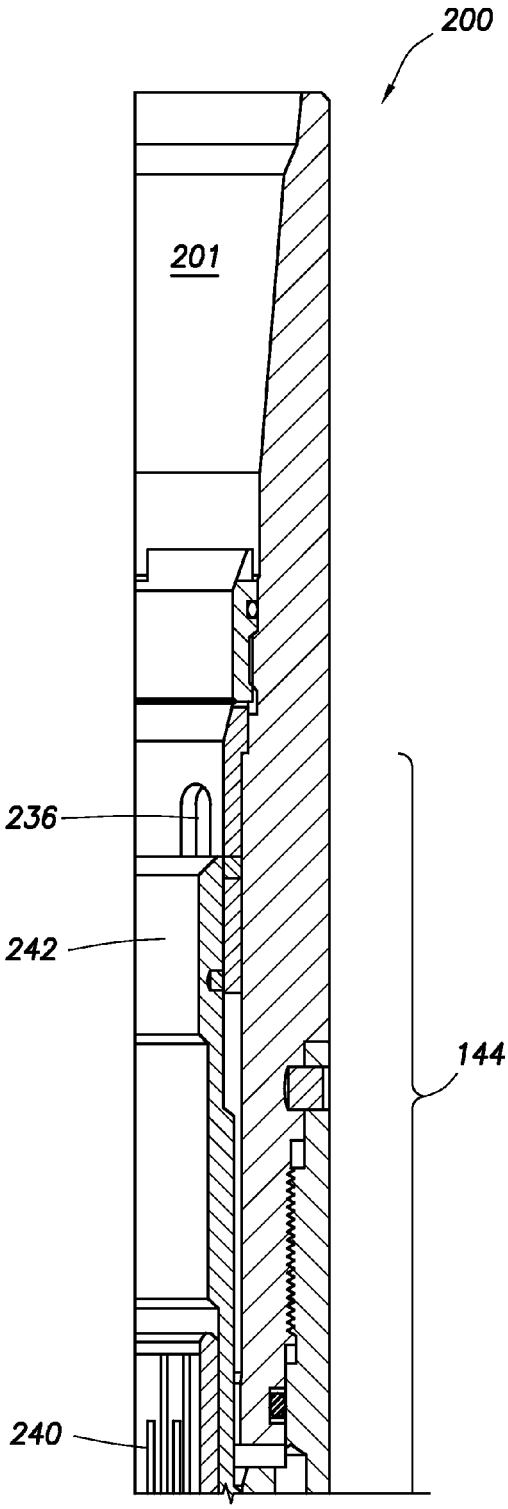
FIG. 8A-8H is a cross-section view of an embodiment of a packer setting tool.
Figure 8B:
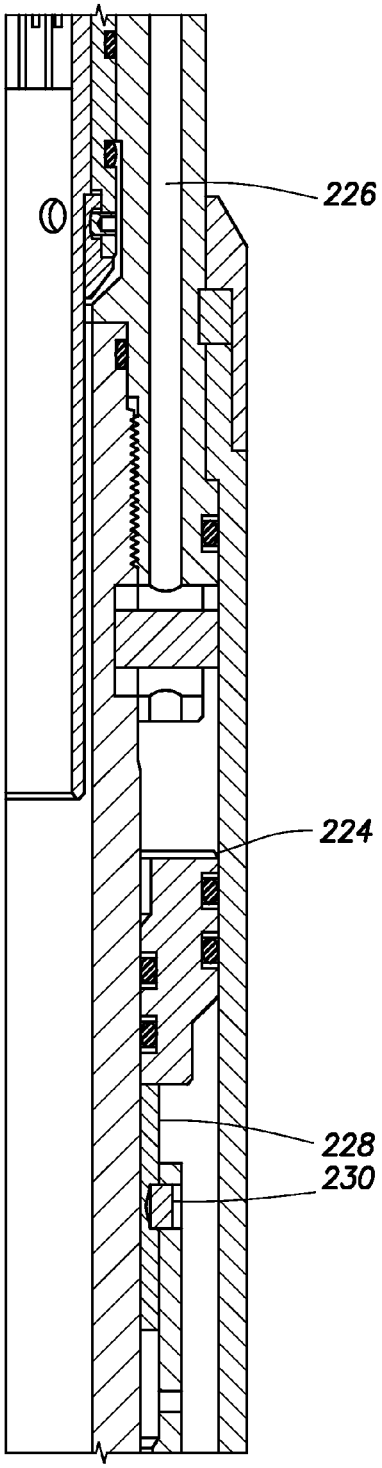
Figure 8C:
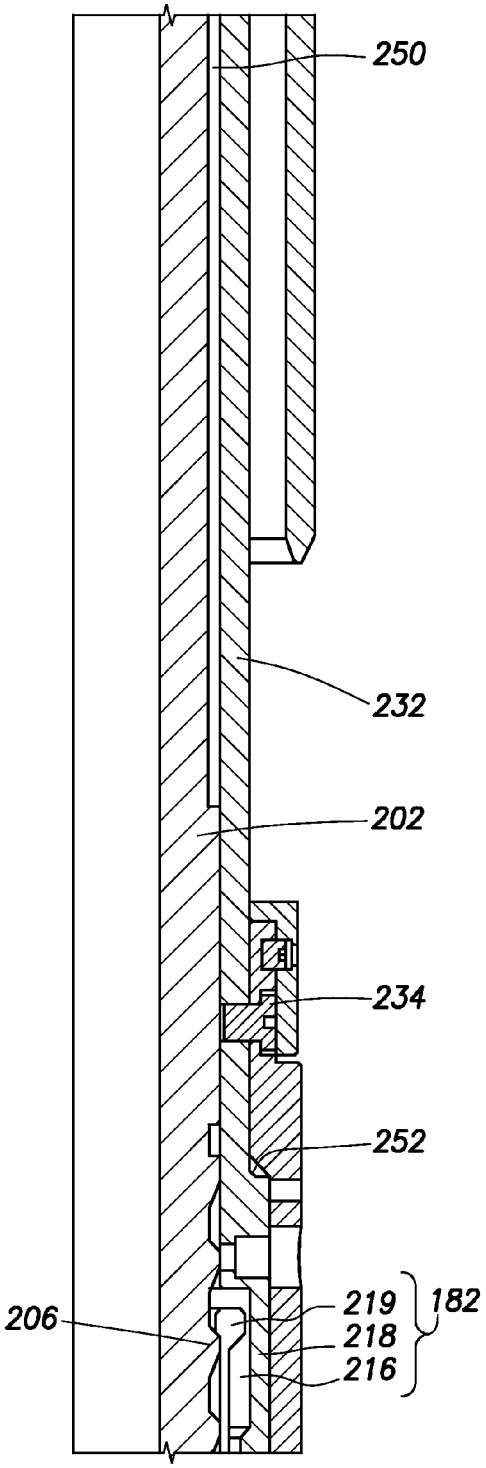
Figure 8D:
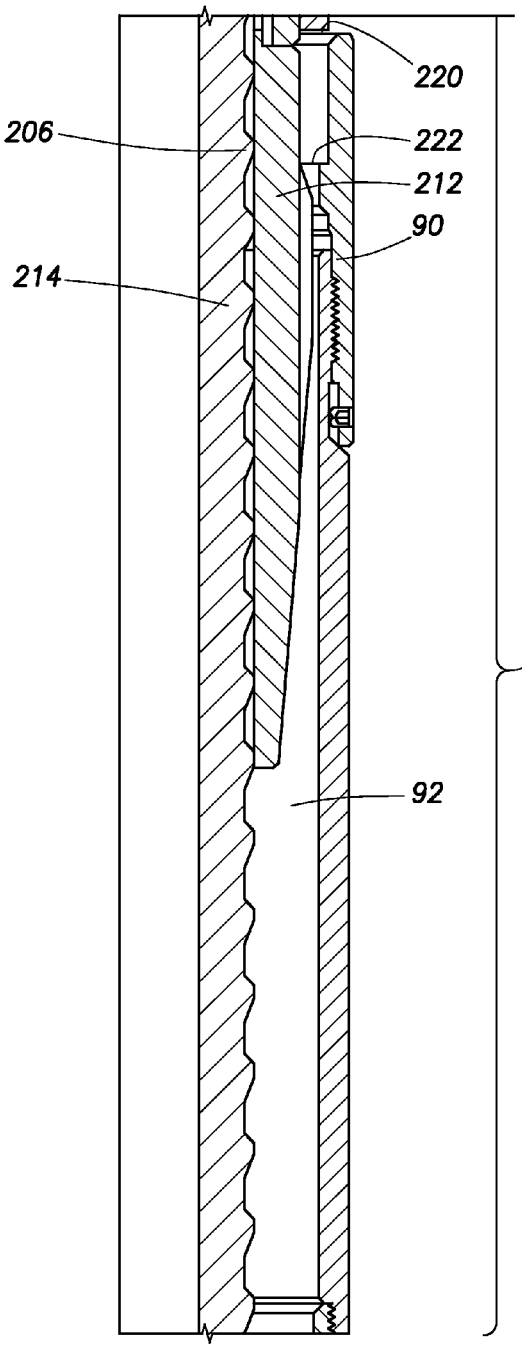
Figure 8E:
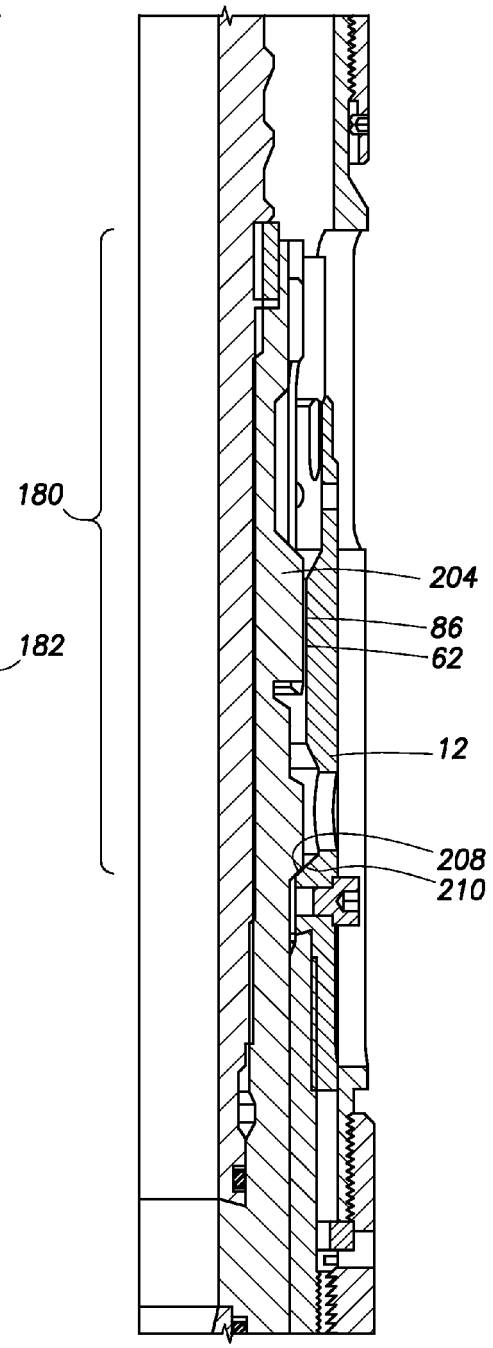
Figure 8F:
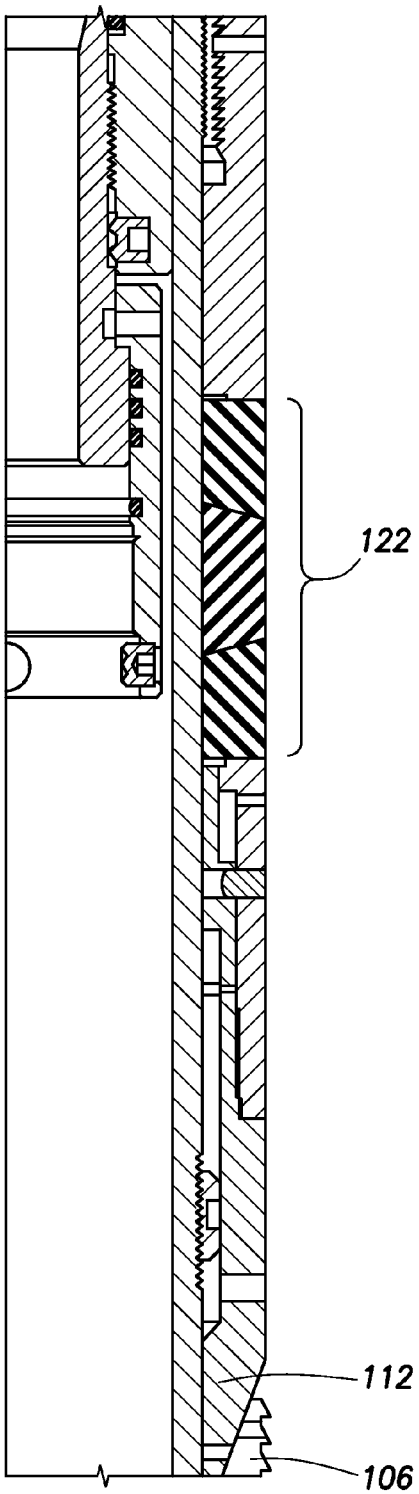
Figure 8G:
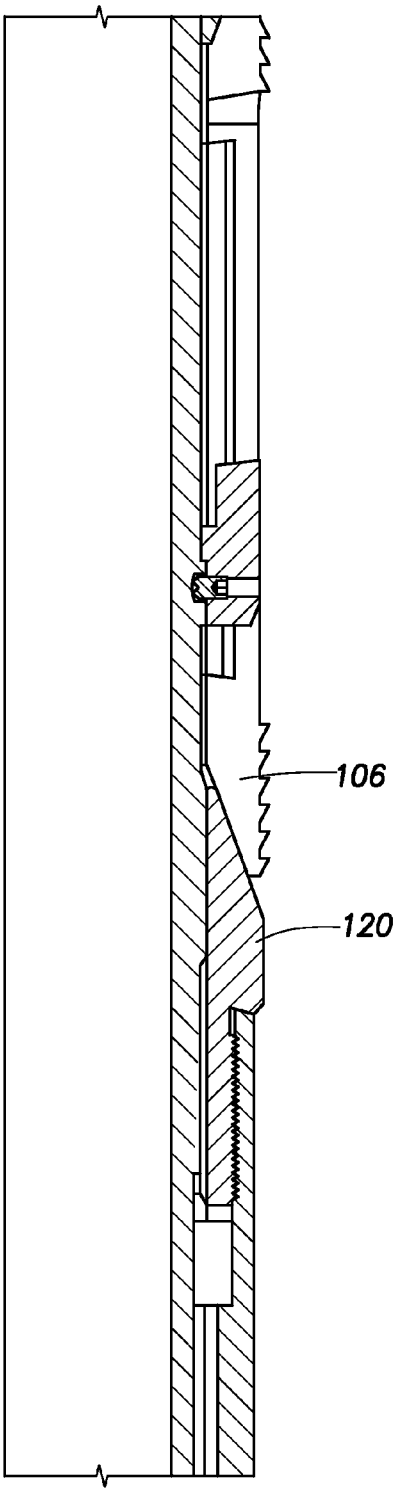
Figure 8H:
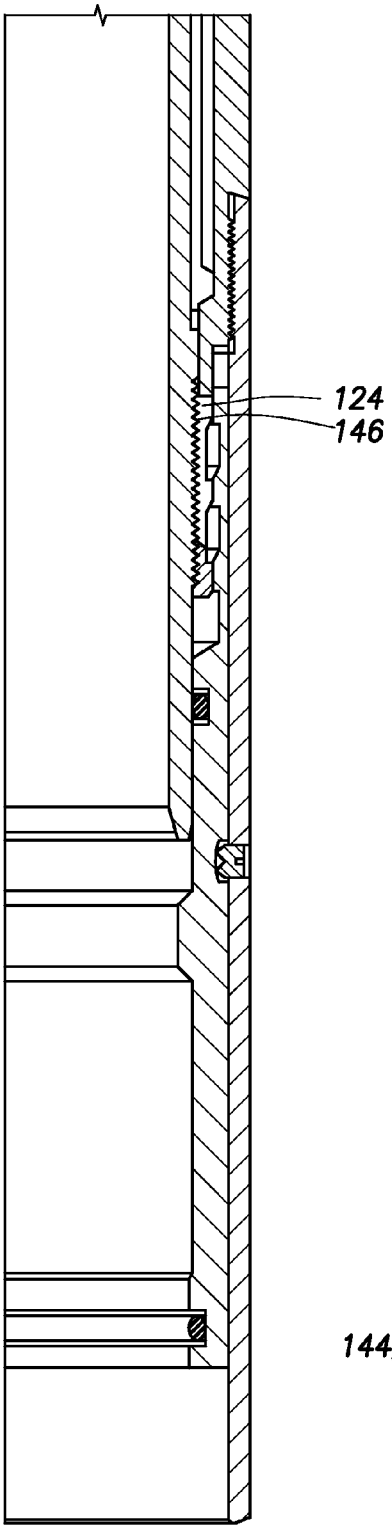
Figure 9A:
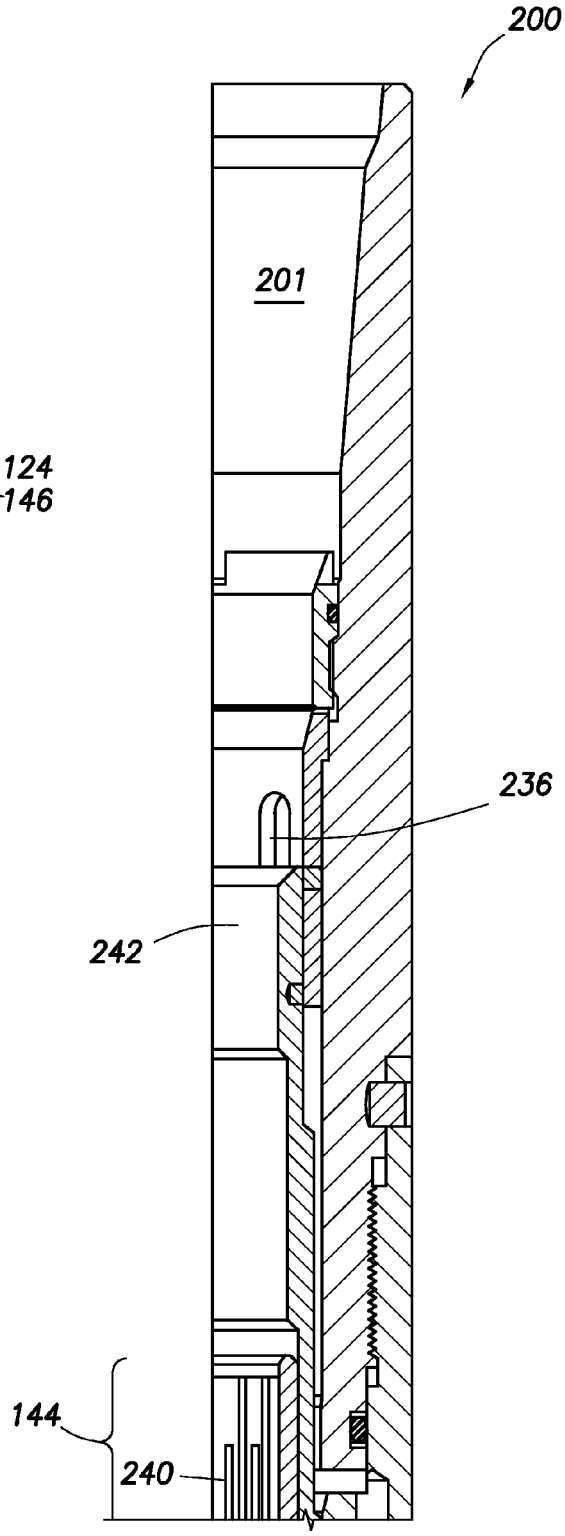
FIG. 9A-9H is a cross-section view of an embodiment of a packer setting tool.
Figure 9B:
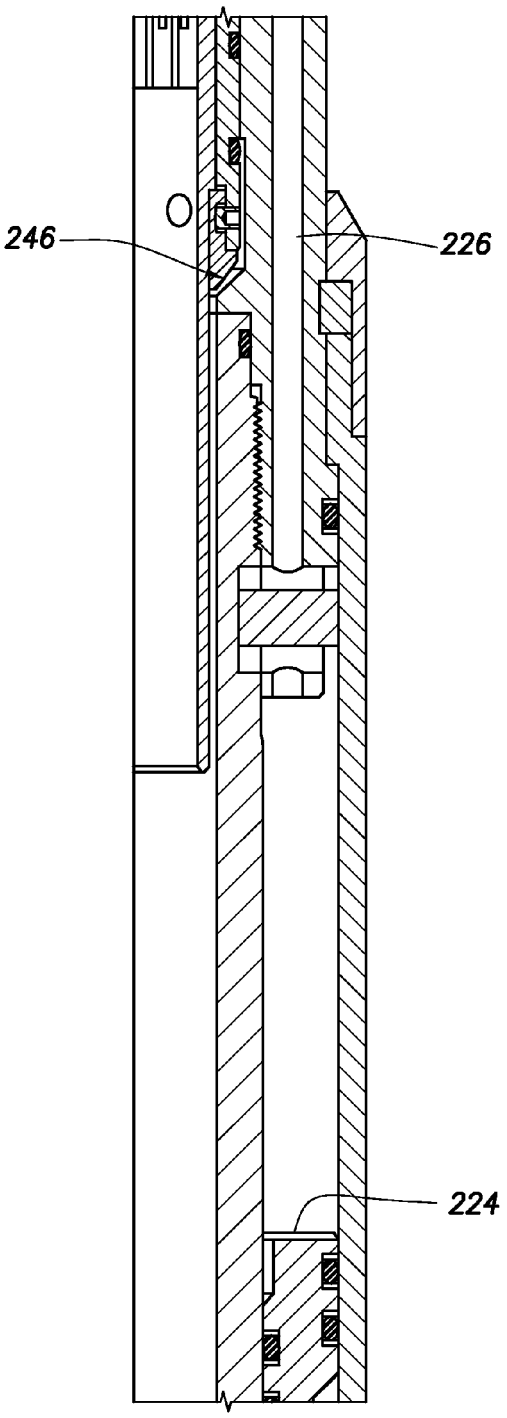
Figure 9C:
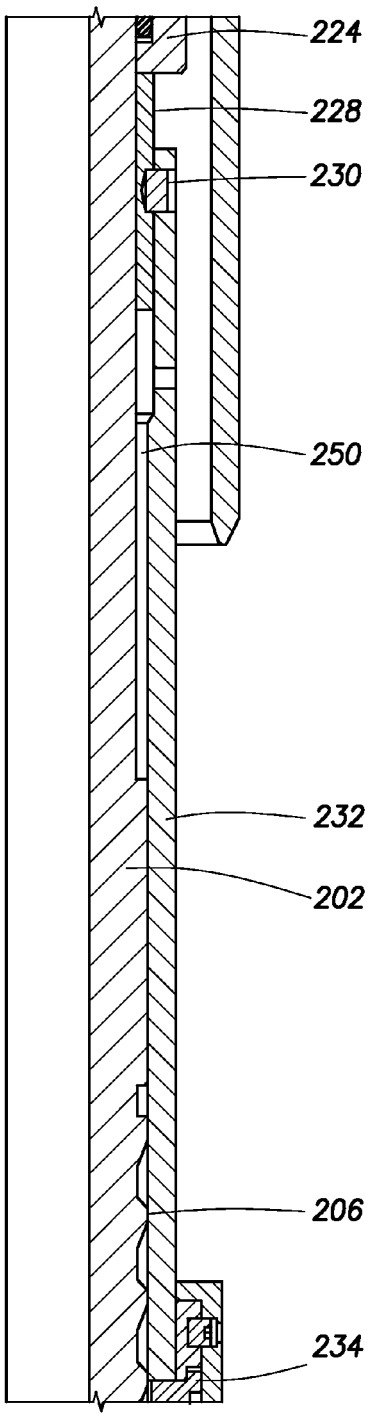
Figure 9D:
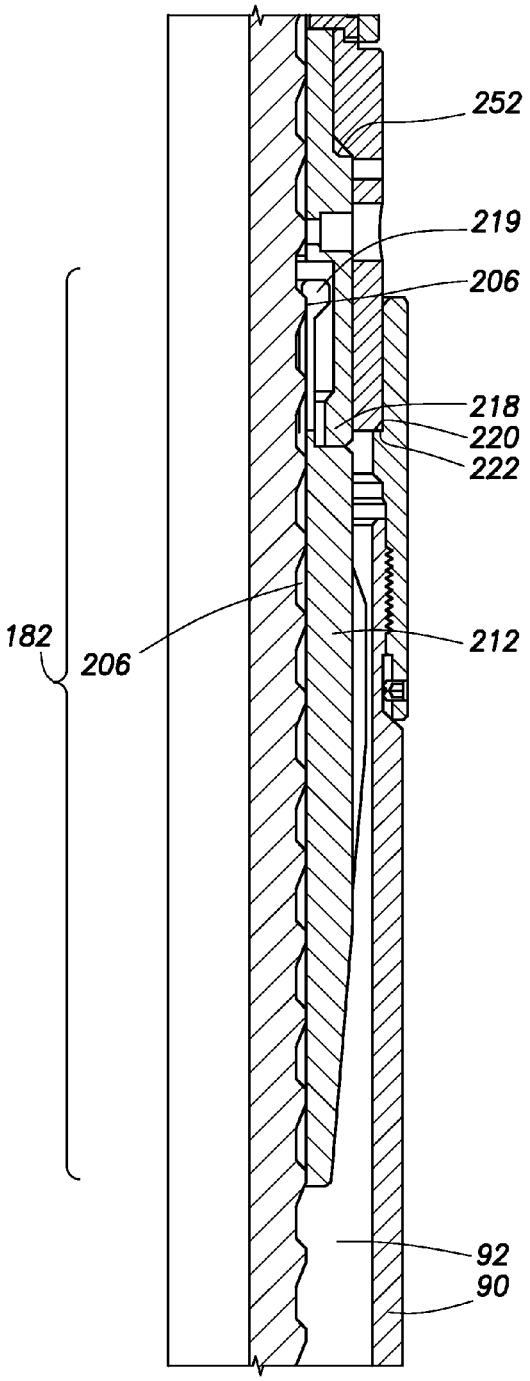
Figure 9E:
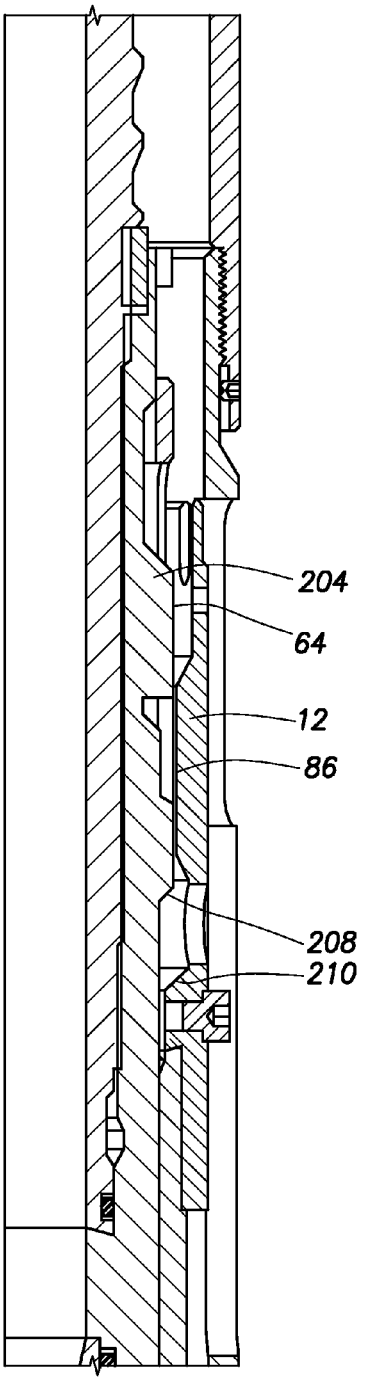
Figure 9F:
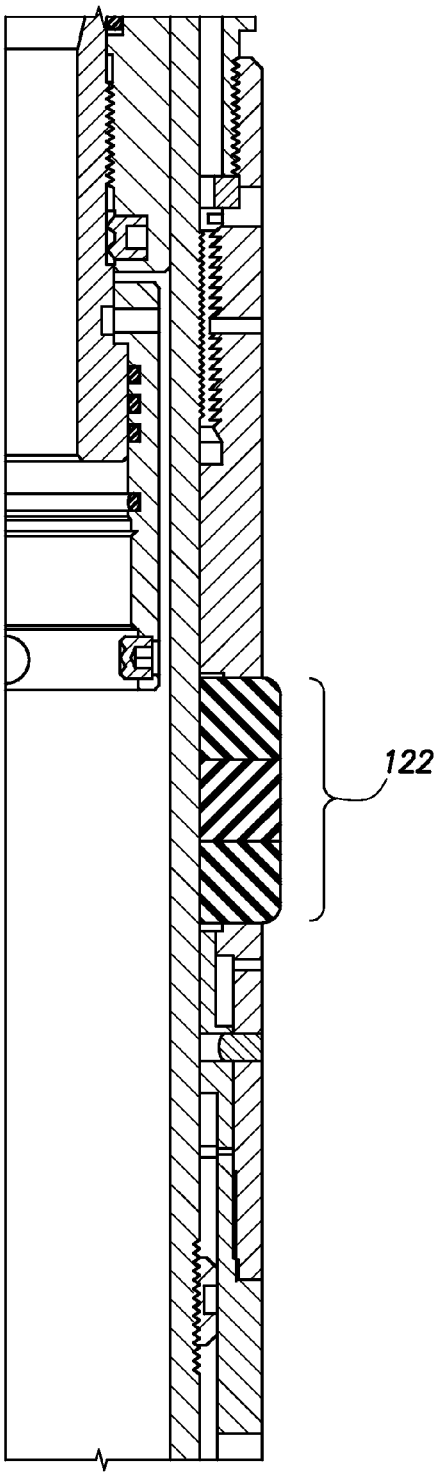
Figure 9G:
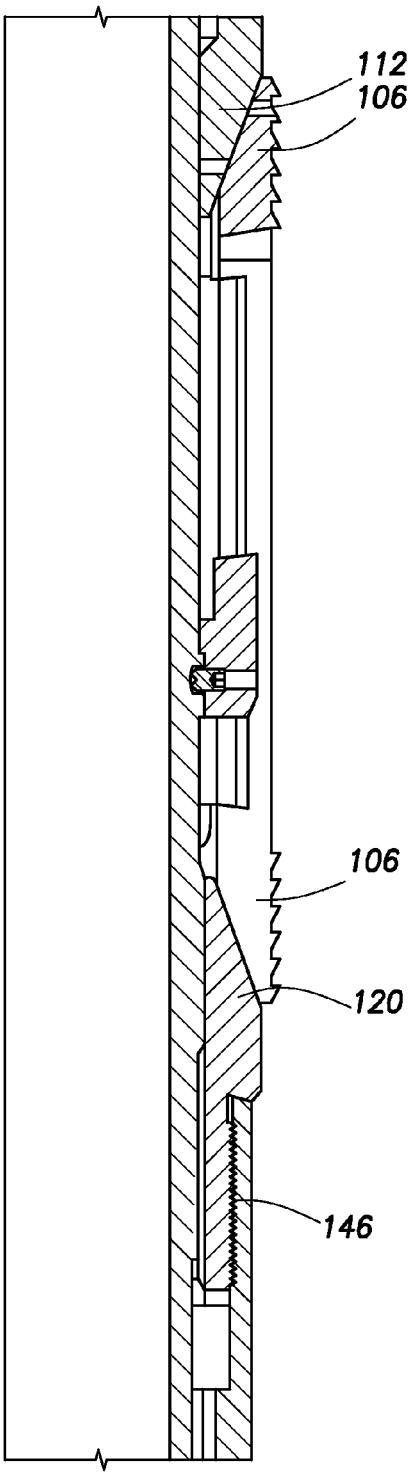
Figure 9H:
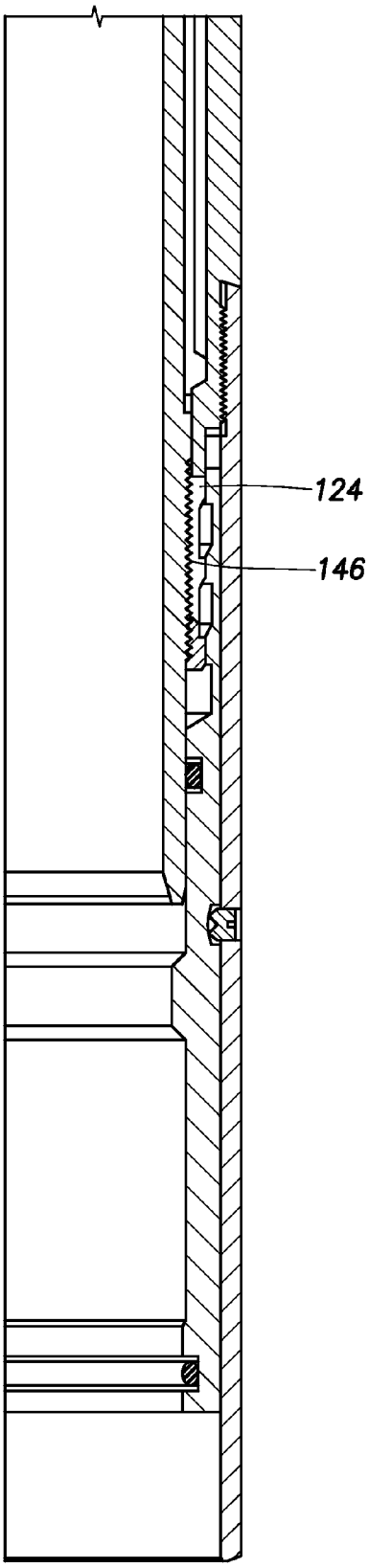
Figure 10A:
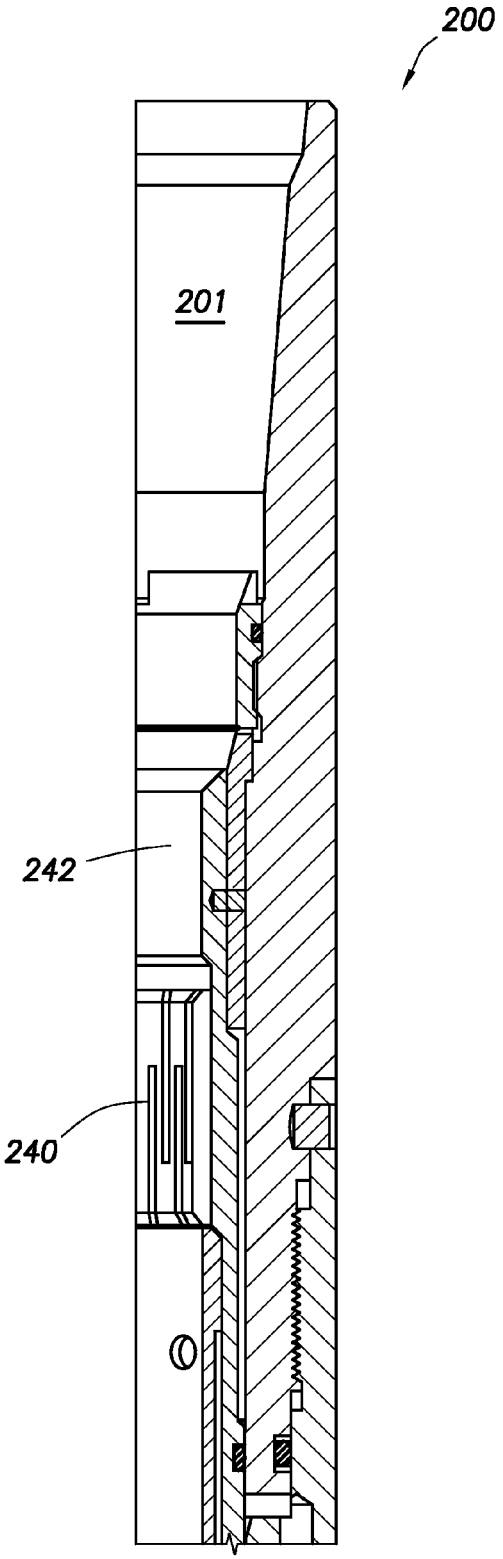
FIG. 10A-10I is a cross-section view of an embodiment of a packer setting tool.
Figure 10B:
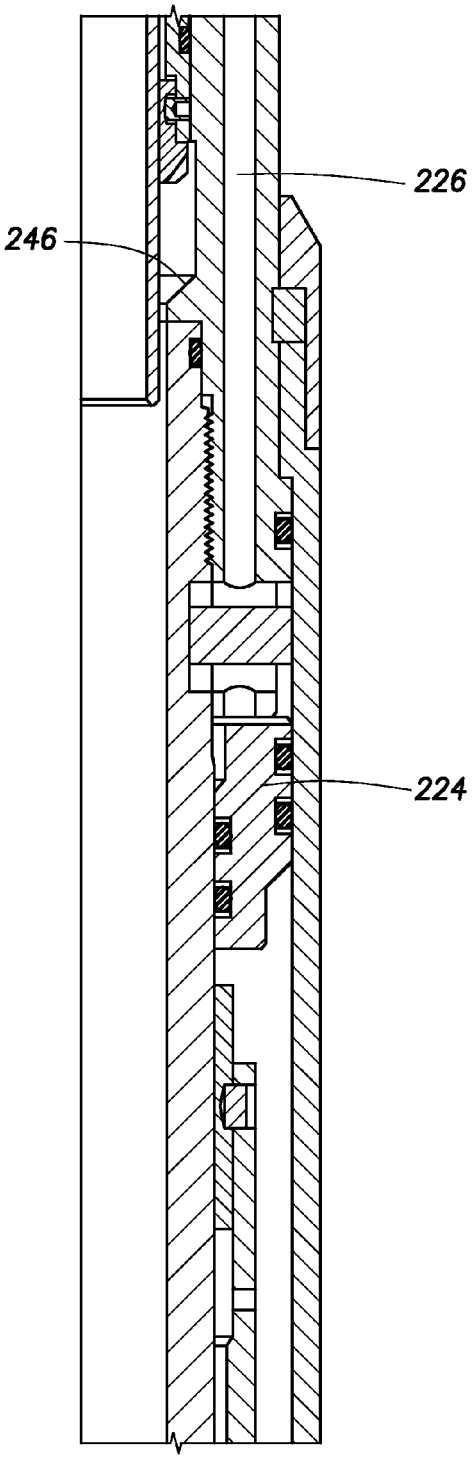
Figure 10C:
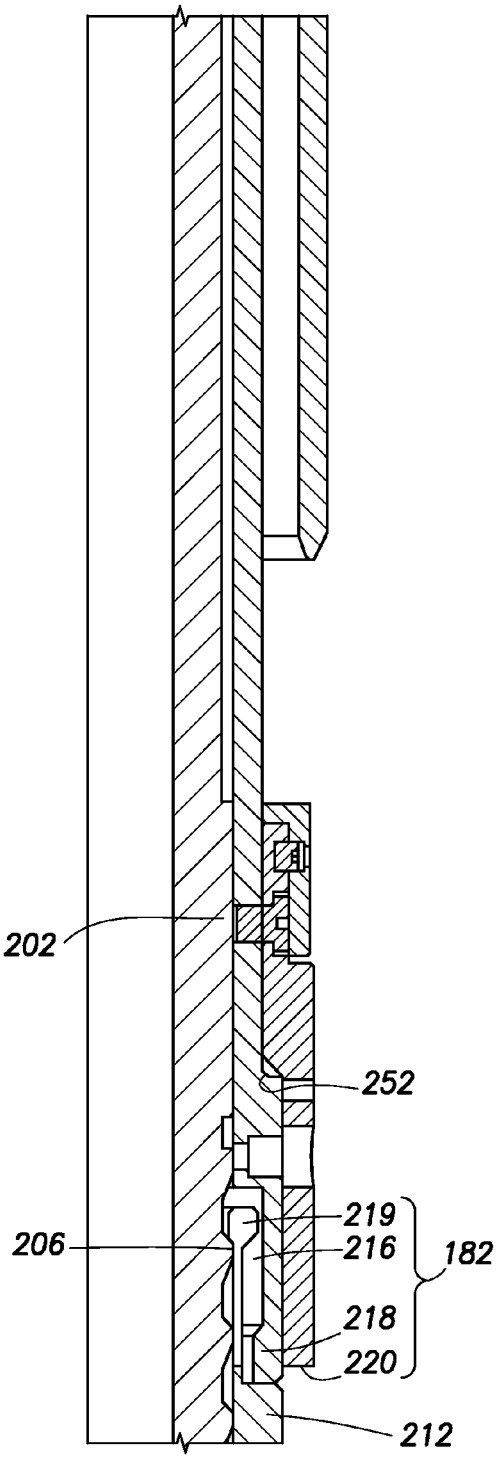
Figure 10D:
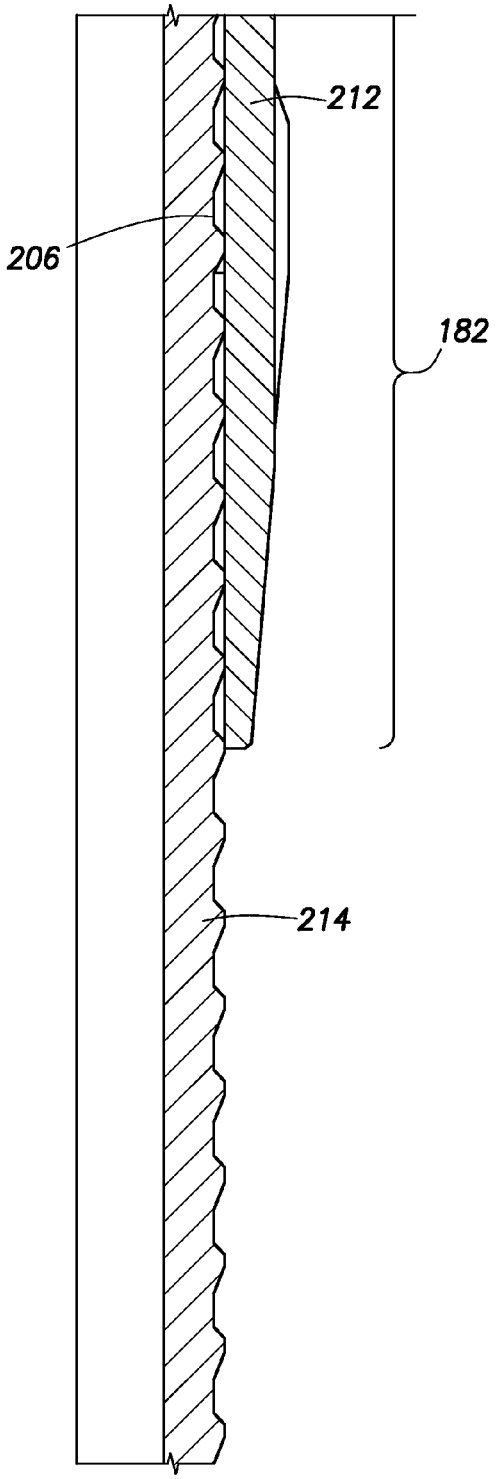
Figure 10E:
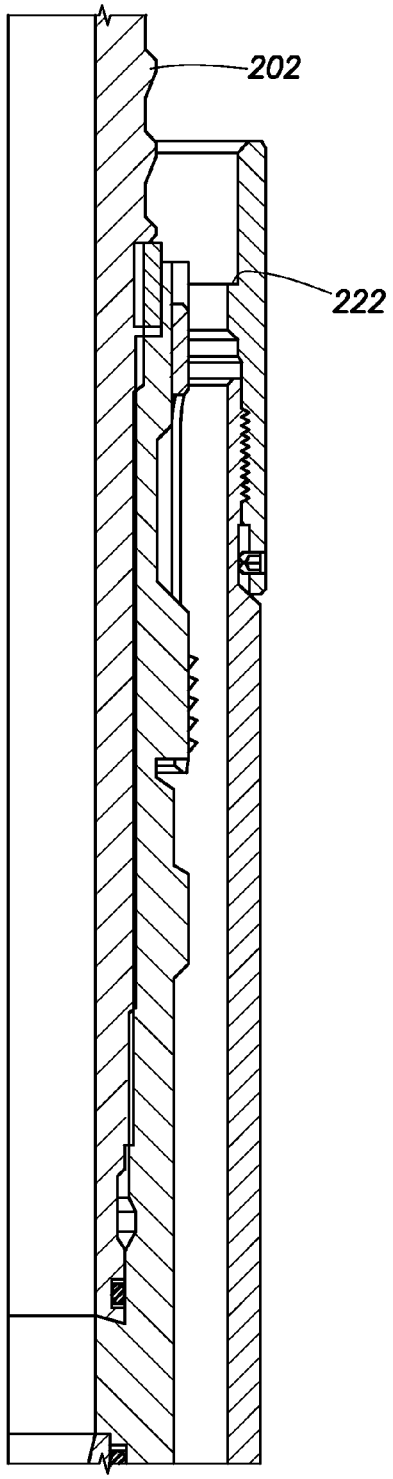
Figure 10F:
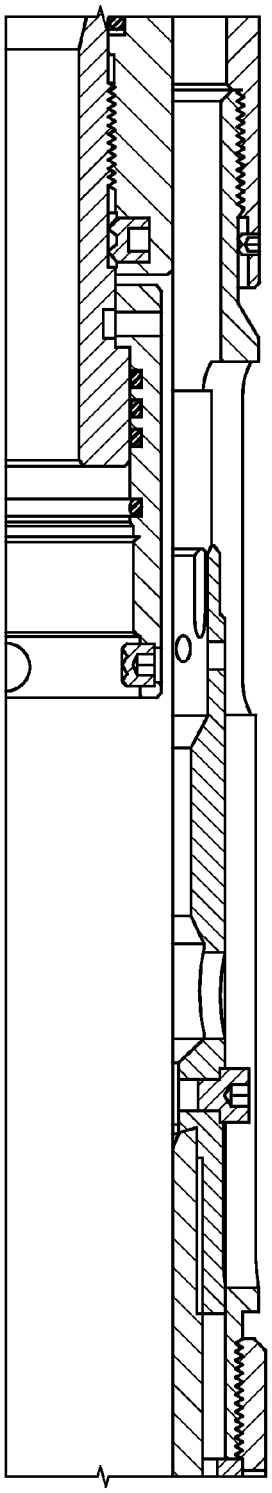
Figure 10G:
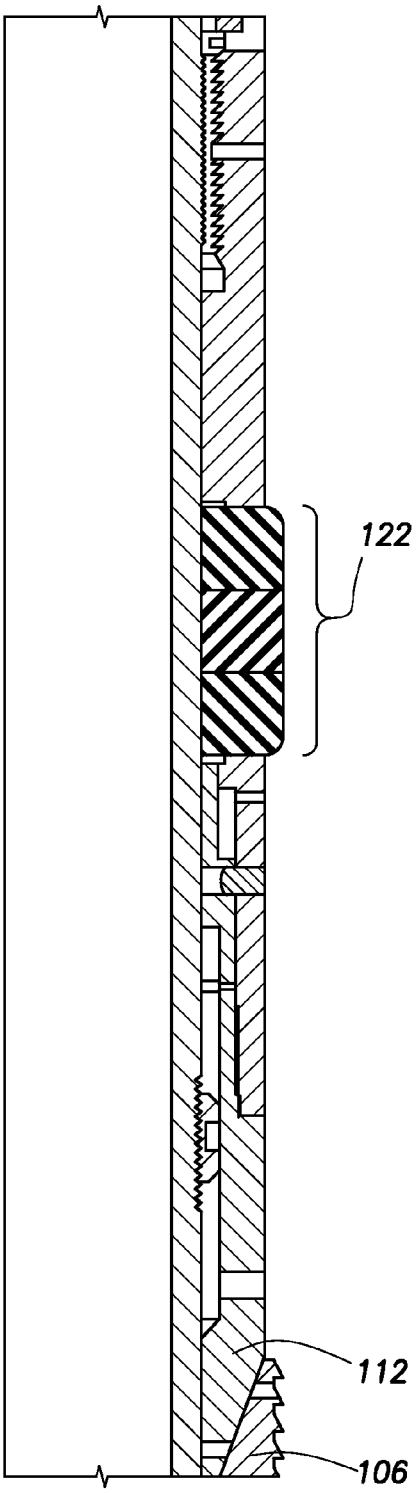
Figure 10H:
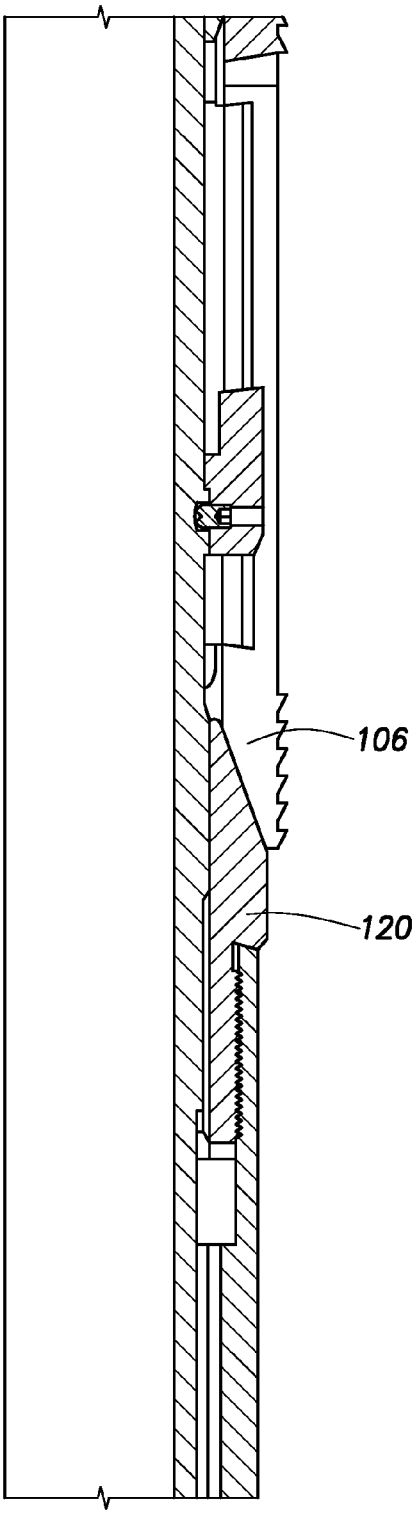
Figure 10I:
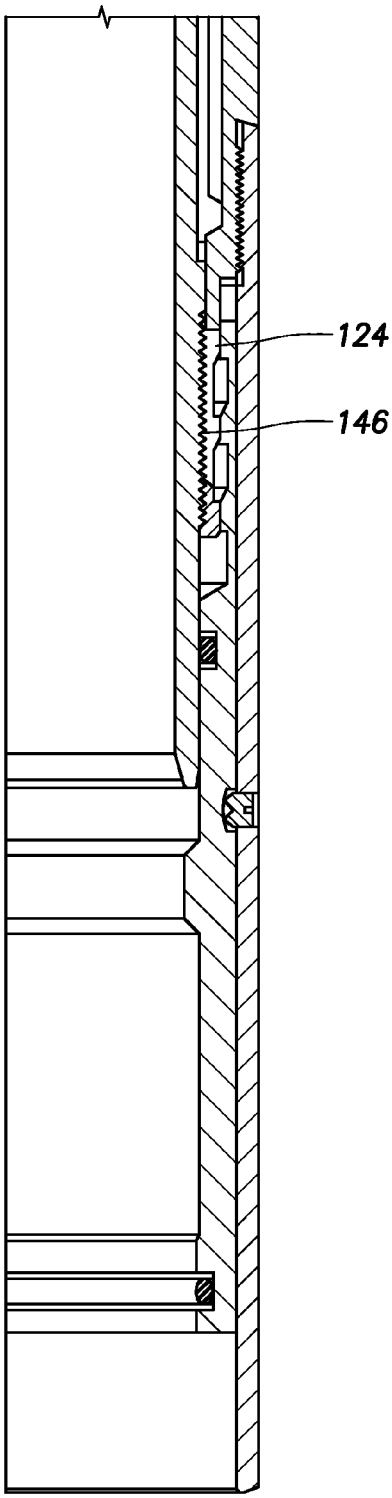

A piston 224 (FIG. 2B) may be disposed in a setting tool annular cavity 226 (FIG. 2B). The piston 224 may seal the portion of the setting tool annular cavity 226 where the piston axially displaces from a setting tool annular cavity opening 236 (FIG. 8A) where fluid is selectively permitted to communicate with setting tool annular cavity 226. The piston 224 may be selectively energized for axial displacement by selectively permitting fluid communication from the central flowbore through the packer setting tool 200 into the setting tool annular cavity 226. When energized, the piston 224 may engage a driving member 228 (FIG. 2B) coupled to a centralizing driving member 232 (FIG. 2C) by an actuatable device 230 such as a shear screw (FIG. 2B). The driving member 228 and the actuatable device 230 will be described in more detail hereinafter. The centralized driving member 232 may be disposed axially adjacent to the slow stroke mandrel 214 and the centralizing member 212. The centralized driving member 232 may be further coupled to the male centralizer member shoulder 220 by a shear screw 234 (FIG. 2C). The shear screw 234 may be designed to shear at about the force required to completely set the packer 76.

When fluid communication is permitted through the setting tool annular cavity opening 236, pressure may increase within the setting tool annular cavity 226 which drives the piston 224 in the axial direction towards the driving member 228. The driving member 228 coupled to the centralizing driving member 232 may also drive the slow stroke mandrel 214. Additionally, the driving member 228 coupled to the centralizing driving member 232 may drive the male centralizer member shoulder 220 engaged with the female packer setting sleeve shoulder 222 towards the packer 76 to energize the packer setting elements.

When the maximum pressure for setting the packer 76 is reached, the shear screw 234 may shear. With this event, the force applied from the centralizing driving member 232 through the male centralizing member shoulder 220 to the female packer setting sleeve shoulder 222 (FIG. 2D) and on to the packer setting sleeve 90 to set the packer 76 may be lost. The shearing of the completion shear screw 234 may alert the operator that the packer 76 is completely set and no further pressure on the packer 76 or packer setting tool 200 is required.

The setting tool annular cavity 226, may also include one or more fluid chokes (e.g., an orifices) so that when fluid communication through the setting tool annular cavity opening 236 is permitted to drive the piston 224, the fluid flow rate may be limited to further control the stroke speed and thus the setting speed of the packer 76. This feature may be used in conjunction with the slow stroke mandrel 214 or it may be a substitute for the slow stroke mandrel 214.

A valve may be disposed to selectively permit fluid communication between the central flowbore through the packer setting tool 200 and the setting tool annular cavity 226. The valve may be selectively energized to allow fluid pressure through the setting tool annular cavity opening 236 to selectively energize the piston 224. As depicted in FIGS. 6A-6H, a ball 238 may be disposed over a collet sleeve 240 and coupled with a sliding member 242. The collet sleeve 240 may be constructed so that before the collet sleeve 240 is energized, the collet valve diameter is not expanded. In another embodiment, the collet sleeve 240 may be constructed so that during or after the collet sleeve 240 is energized the collet sleeve diameter is not at its maximum. The collet sleeve 240 may be integrated with a sliding member 242. The sliding member 242 may be coupled to the setting tool mandrel 202 by a sleeve shear screw 244 so that before the sleeve shear screw 244 is sheared the sliding member 242 prohibits fluid communication through the setting tool annular cavity opening 236.

After the packer setting tool 200 is engaged with packer 76 so that the male no-go 208 is engaged with the female packer no-go 210, and the latch 204 engages the threads 86, the ball 238 may be inserted over the collet sleeve 240 to block fluid communication through the central flow bore 201. When pressure reaches a threshold across the ball 238 the shear screw 244 may shear and decouple the sliding member 242 from the setting tool mandrel 202. The sliding member 242 may slide along the setting tool mandrel 202 toward the packer 76 exposing the setting tool annular cavity opening 236 to the central flow bore 201 permitting fluid communication between the central flow bore 201 and the setting tool annular cavity 226. The sliding member 242 slides along the setting tool mandrel 202 until it reaches and engages the no-go shoulder 246. At this time, the ball 238 may remain over the collet valve 240 blocking fluid communication through the central flow bore 201. In this position, the fluid pressure above the ball may be used to set the packer. When pressure reaches a second threshold, the pressure on the ball 238 may cause the diameter of the collet valve 240 to increase allowing the ball 238 to fall through the collet valve 240 and down through the central flow bore 201 permitting fluid flow.

The valve to selectively permit fluid communication between the central flowbore 201 and the setting tool annular cavity 226 should not be limited to the embodiment herein disclosed. In another embodiment, the valve maybe actuated using an electronic actuator which sends a signal to open the setting tool annular cavity opening 236 when pressure meets a threshold. Additionally, the valve may be of any type known by those skilled in the art for this intended purpose.

As previously mentioned, the driving member 228 may be coupled to the centralizing driving member 232 by the shear screw 230. In the event that pressure continues to be applied to the piston 224 after the shear screw 234 shears, the shear screw 230 may shear and decouple the driving member 228 from the centralizing driving member 232 to prevent the centralizing driving member 232 from applying excess force on the packer 76, which may potentially damage the packer 76. In the event where the shear screw 230 shears and pressure is still applied to the piston 224, the piston may solely drive the decoupled driving member 228 into the annulus 250. If pressure continues to be applied on the piston 224, the distance of the annulus 250 may allow the piston 224 driving the driving member 228 to reach the pressure release opening so that pressure is diverted and can no longer be applied to drive the piston 224.

Looking at FIGS. 2A-2H, and as also shown in various embodiments in FIGS. 3-10I, a packer 76 may be cooperatively engaged with the packer setting tool 200 of FIG. 1 in a packer setting tool system. It is to be understood that the packer 76 is a continuous assembly, although it is shown in a succession of separate figures. The packer 76 comprises a packer setting sleeve 92 formed by an axially upwardly extending generally tubular inner mandrel 78 and a packer setting sleeve 90 cooperatively shaped for engagement with the packer setting tool 200. Thus, when the setting tool mandrel 202 is inserted axially within the setting sleeve 92, the packer setting sleeve 90 may engage at the female packer setting sleeve shoulder 222 with the male centralizer member shoulder 220. Such cooperative engagement between the setting tool mandrel 202 and the packer setting sleeve 90 is representatively illustrated in FIG. 9D.

Figure 2G:
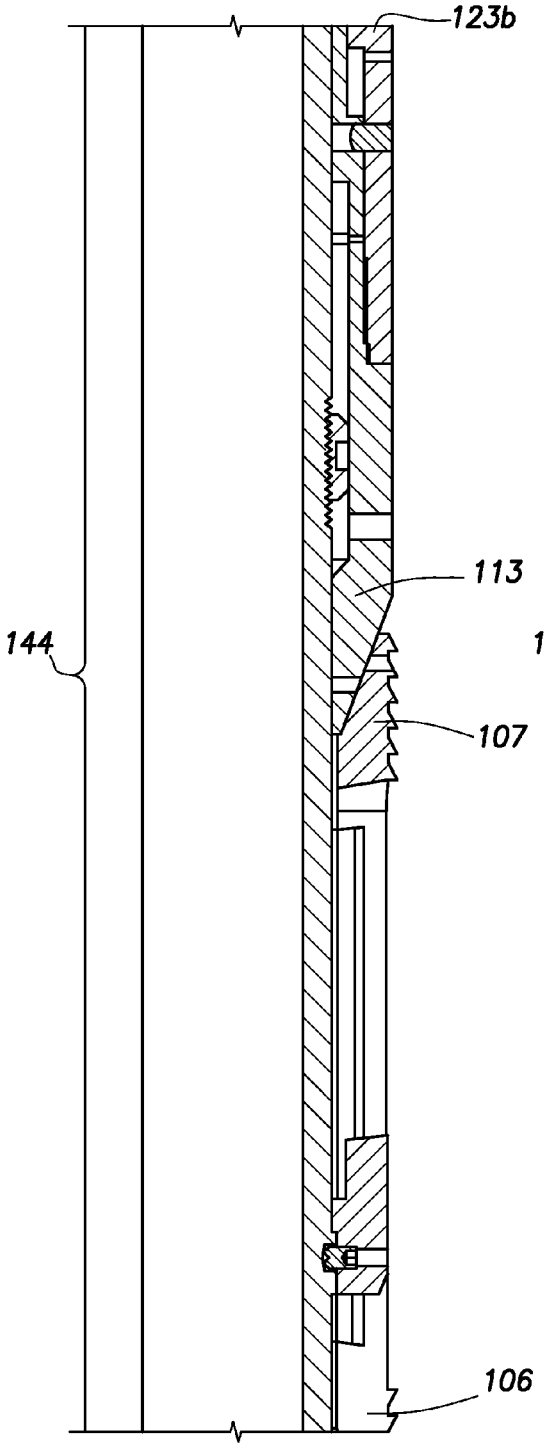
Figure 2H:
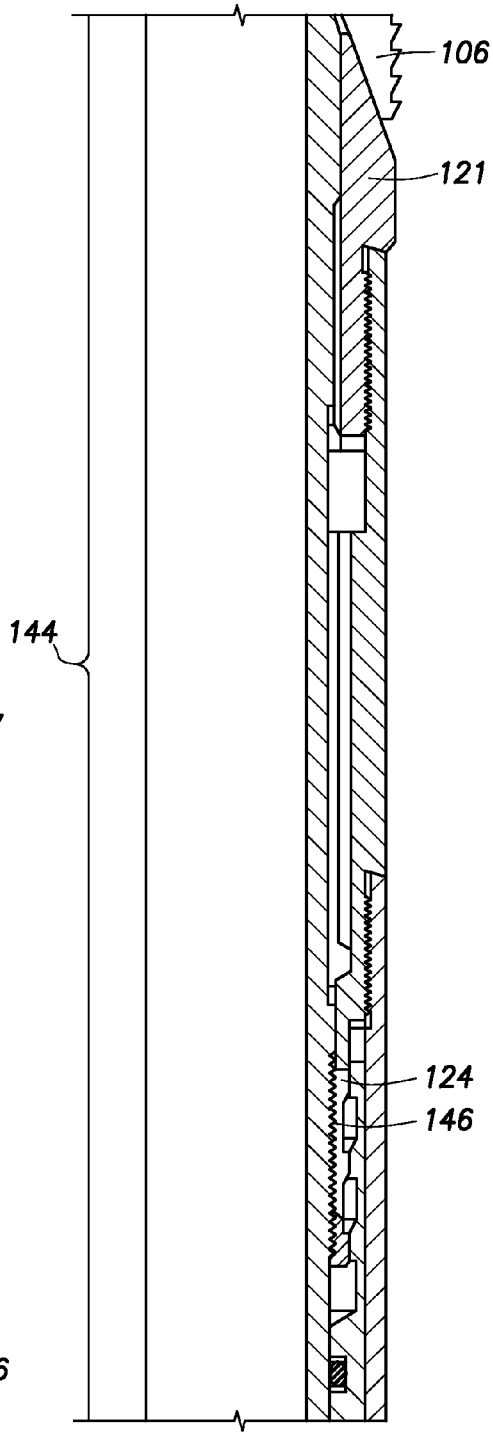
Figure 2I:
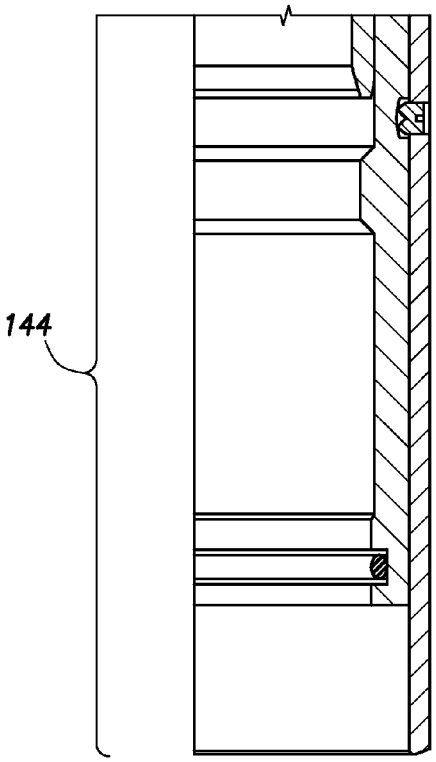
Figure 6A:
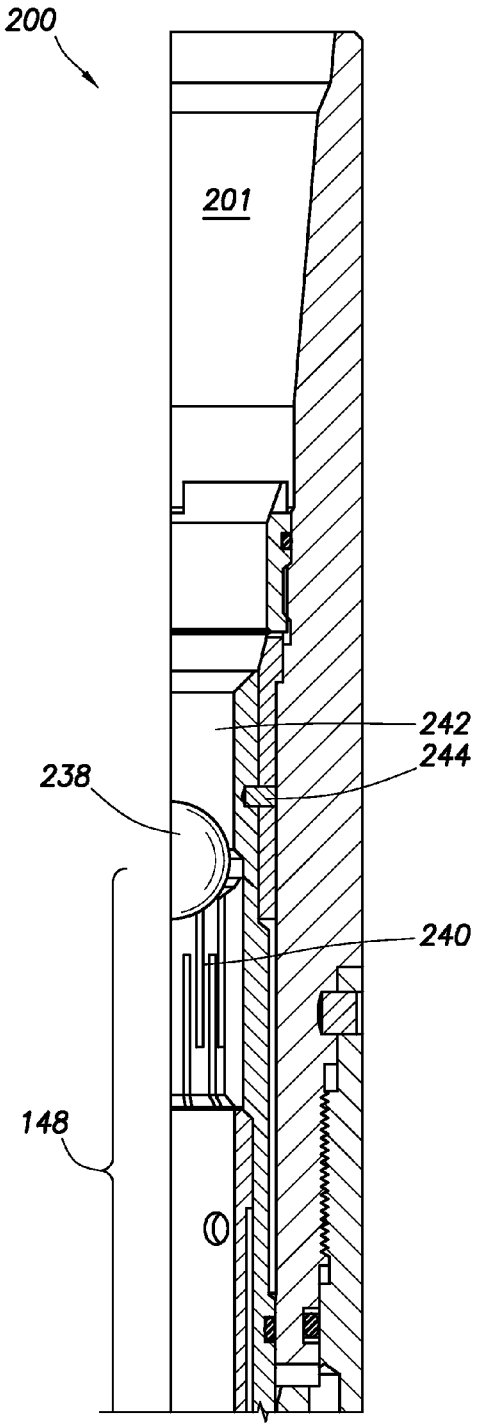
FIG. 6A-6H is a cross-section view of an embodiment of a packer setting tool engaging a packer.
Figure 3:
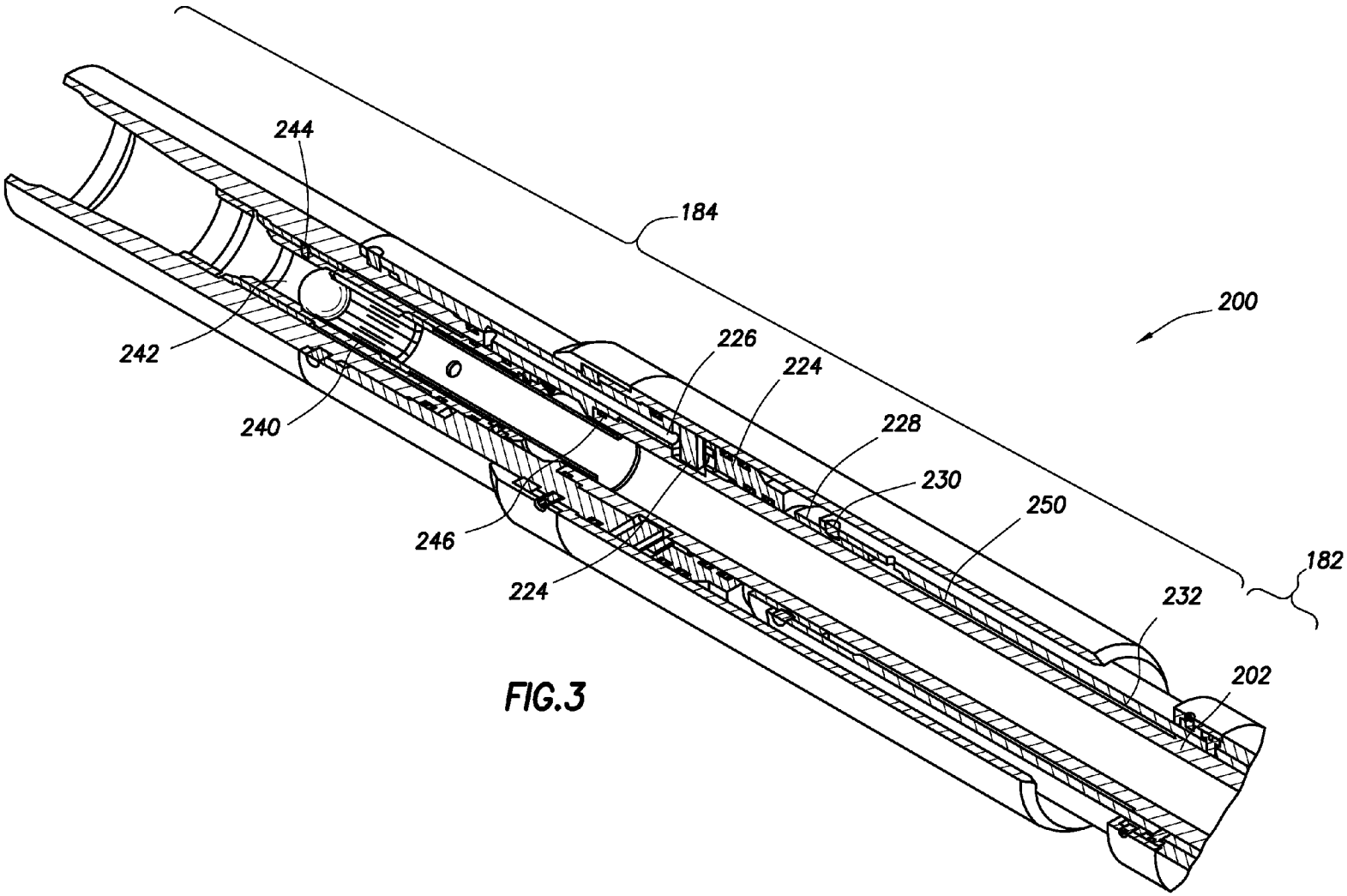
FIG. 3 is a cross-section view of an embodiment of a packer setting tool engaging a packer.
Figure 4:
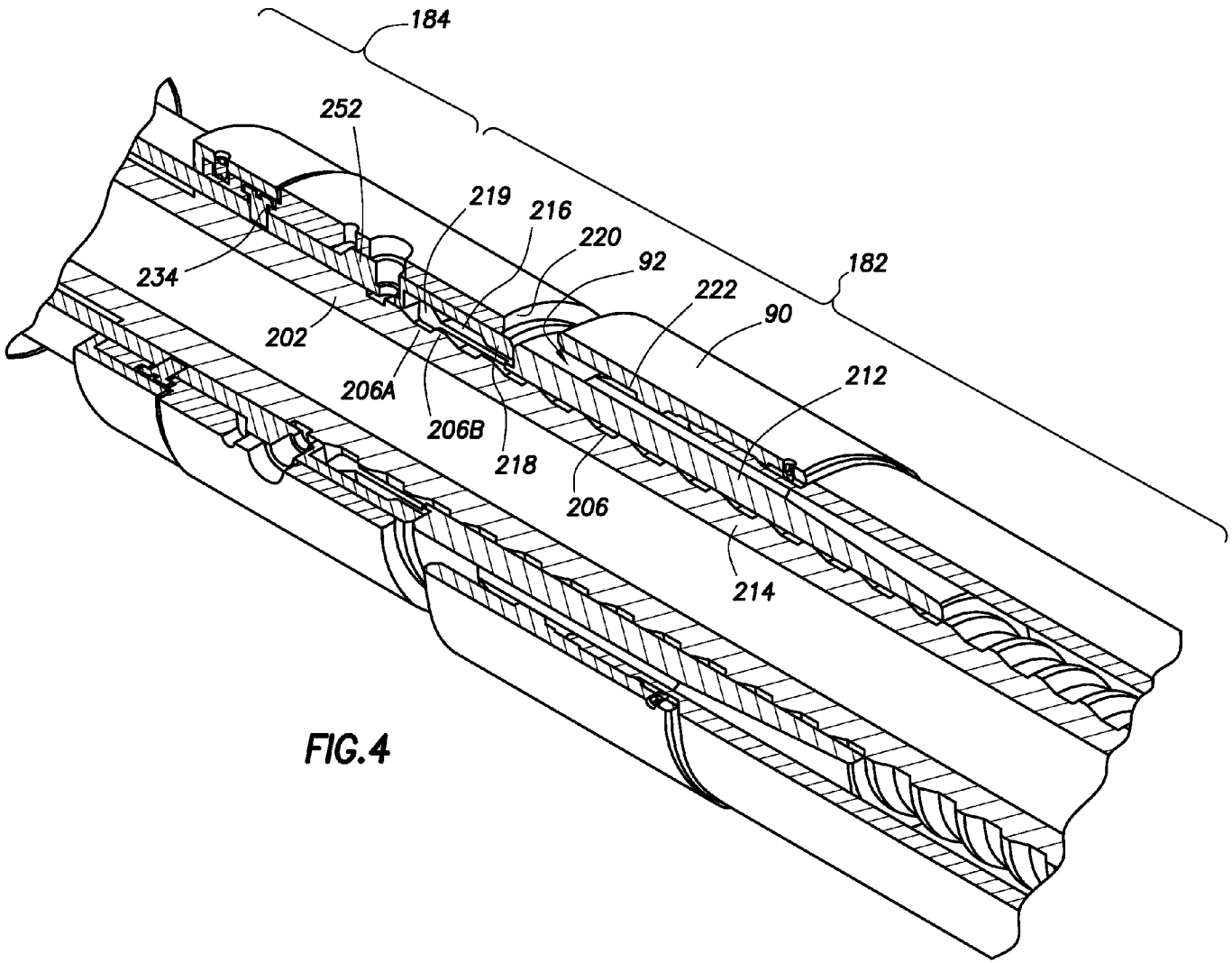
FIG. 4 is a cross-section view of an embodiment of a packer setting tool engaging a packer.
Figure 5:
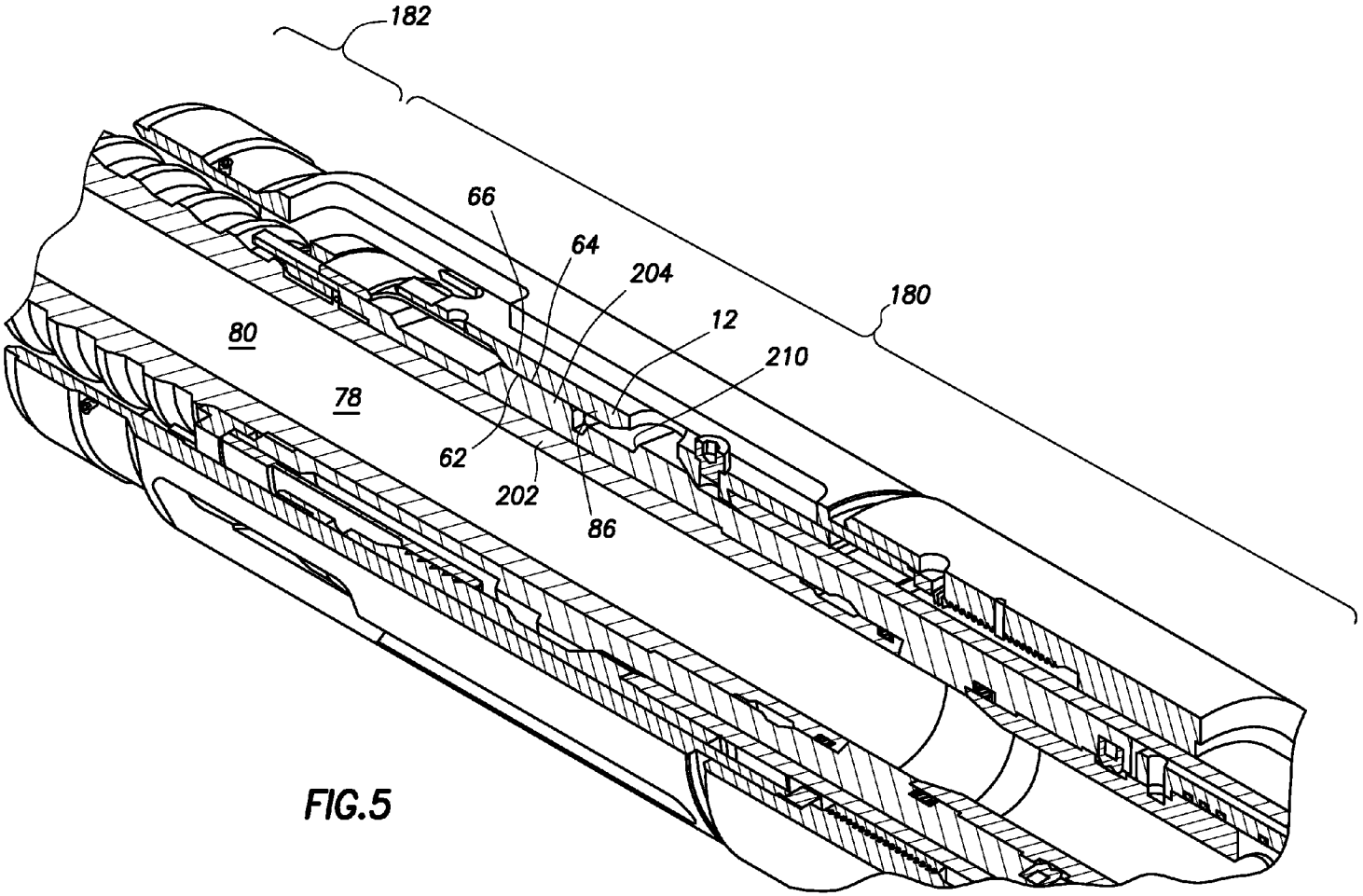
FIG. 5 is a cross-section view of an embodiment of a packer setting tool engaging a packer.
Figure 6B:
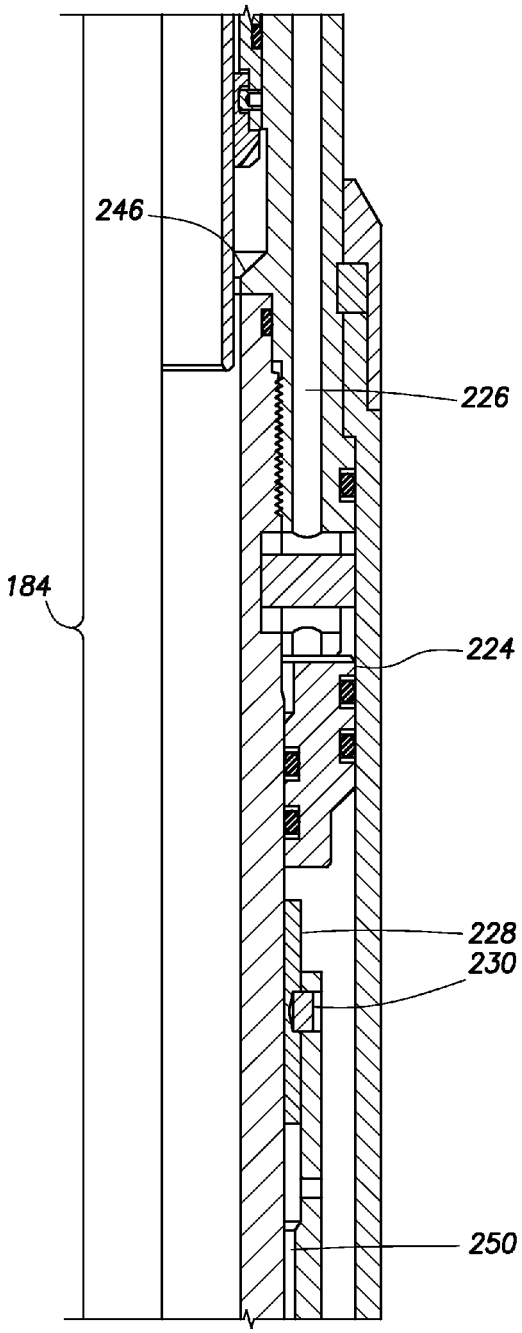
Figure 6C:
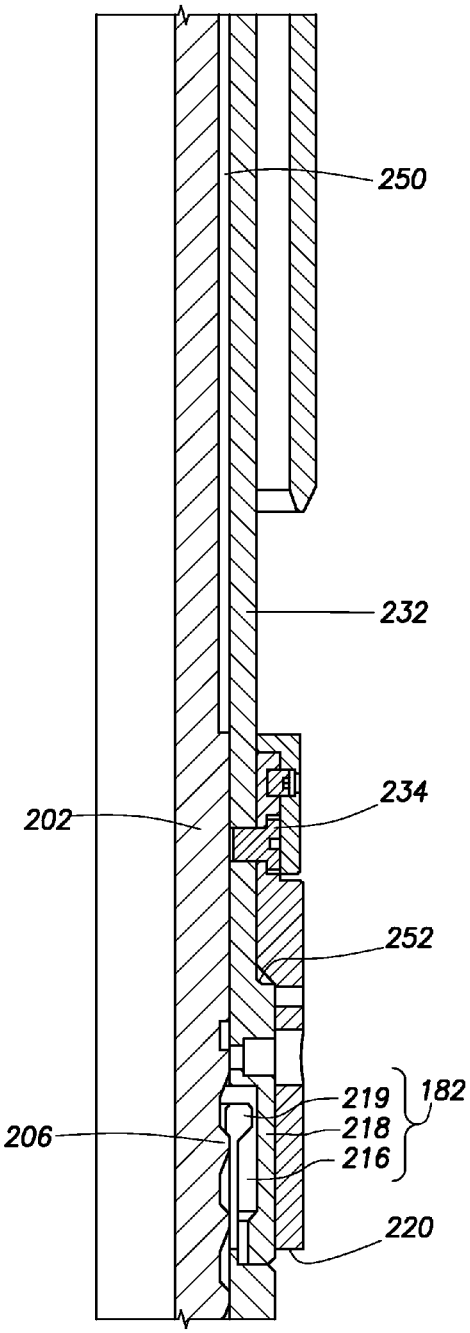
Figure 6D:
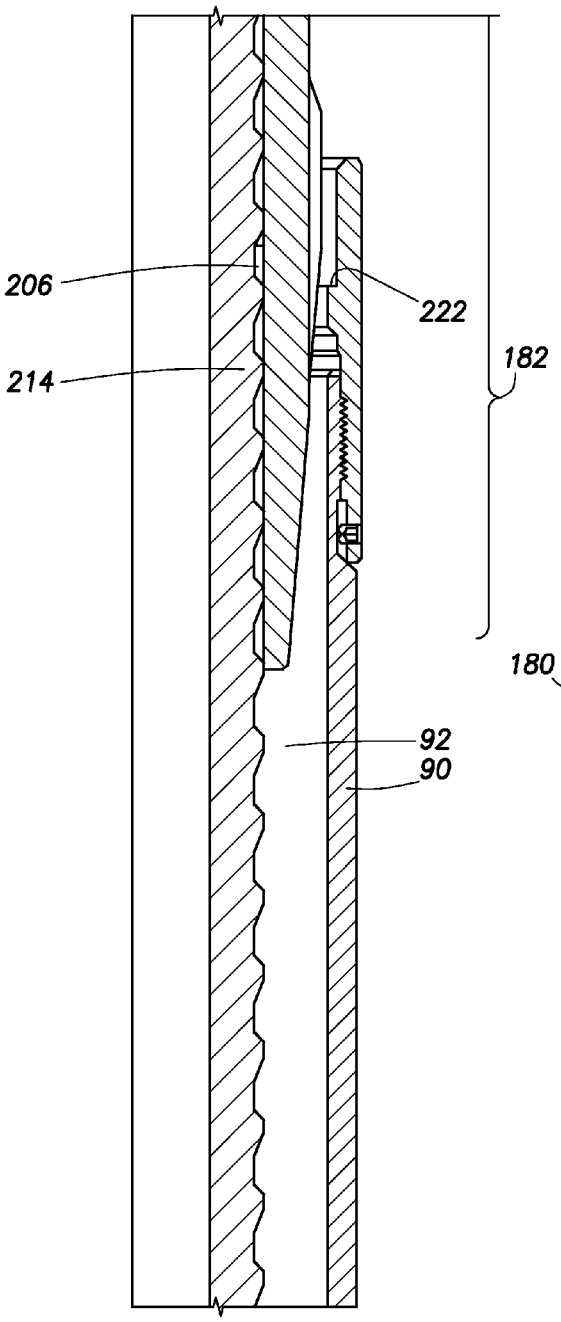
Figure 6E:
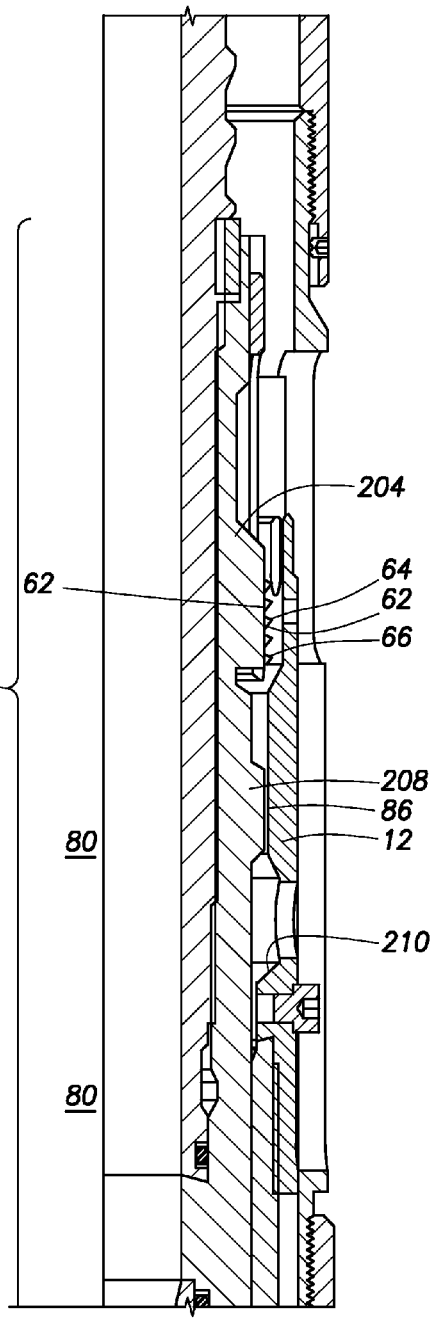
Figure 6F:
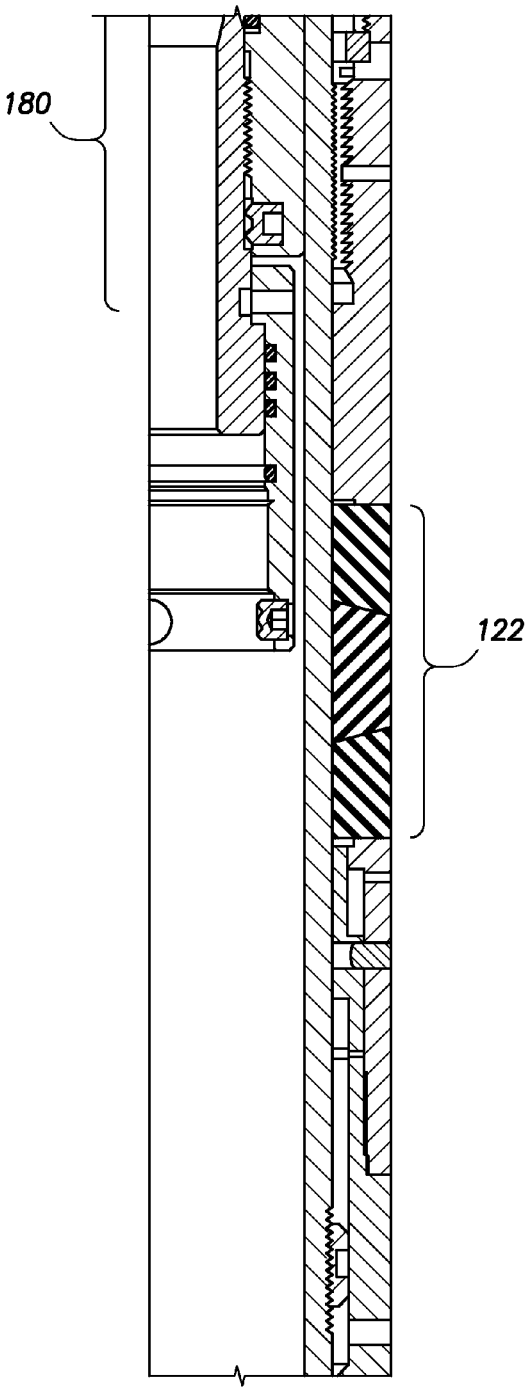
Figure 6G:
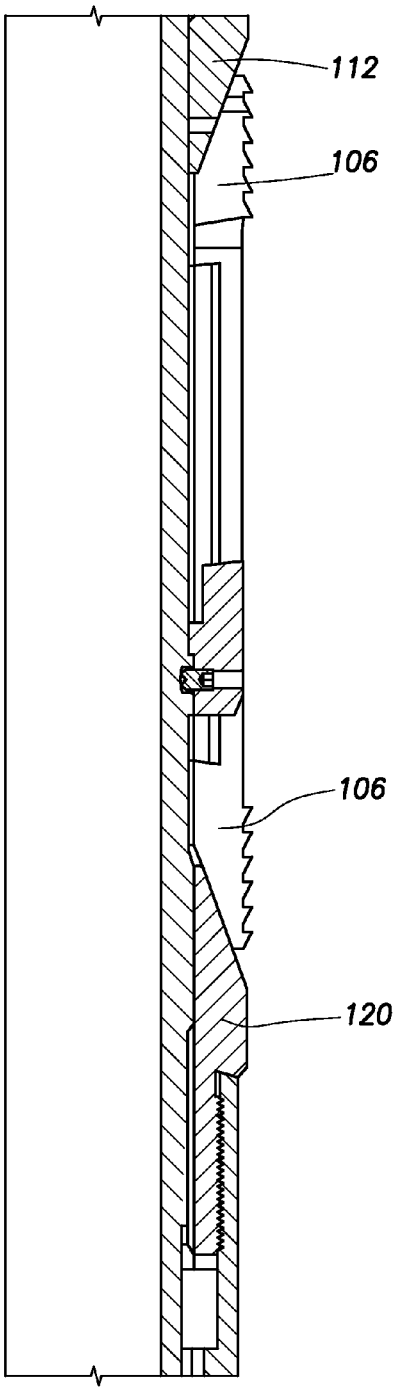
Figure 6H:
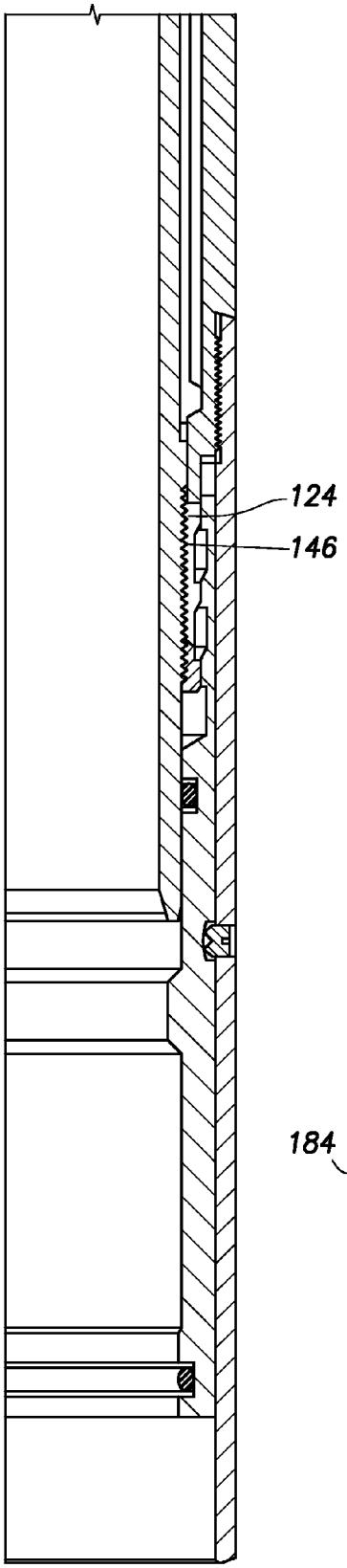
Figure 7A:
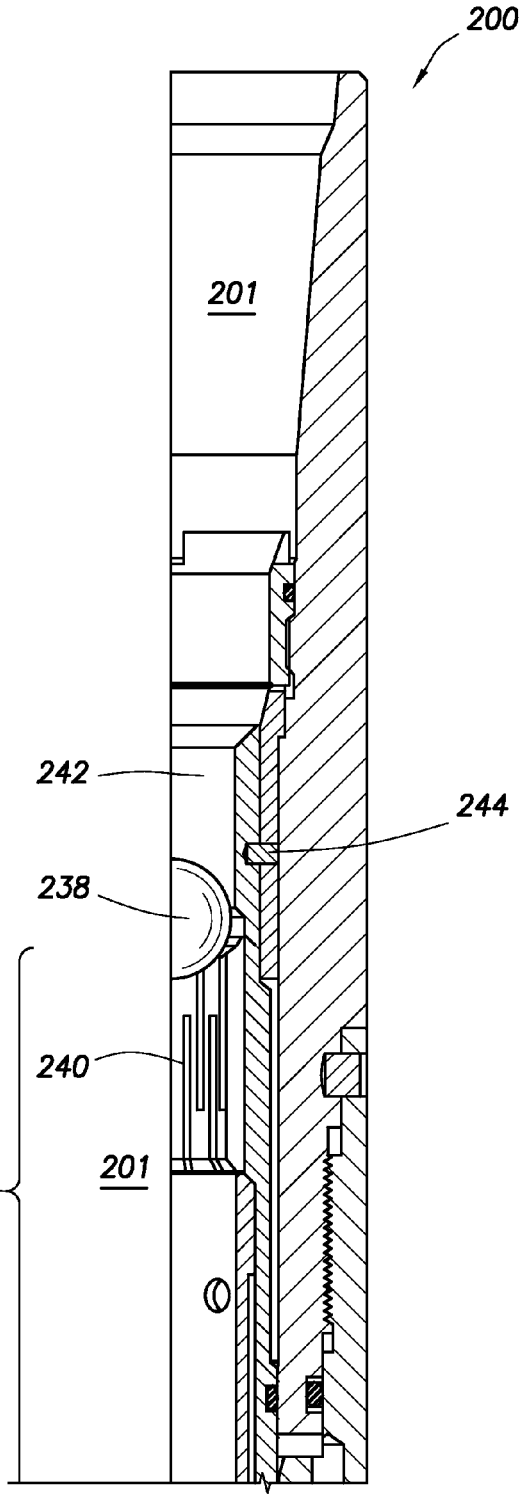
FIG. 7A-7H is a cross-section view of an embodiment of a packer setting tool engaging a packer.
Figure 7B:
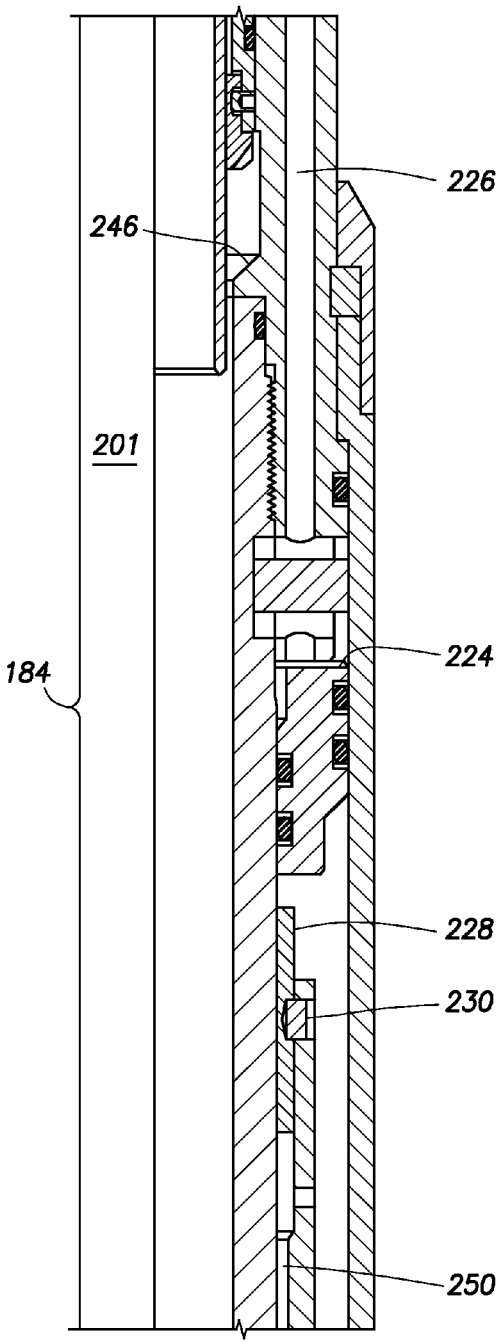
Figure 7C:
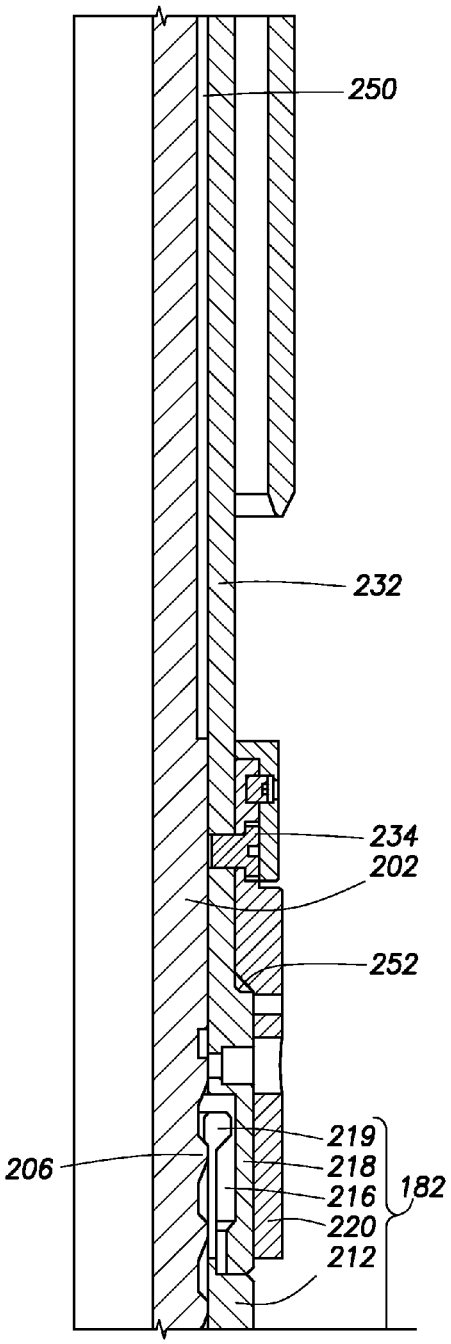
Figure 7D:
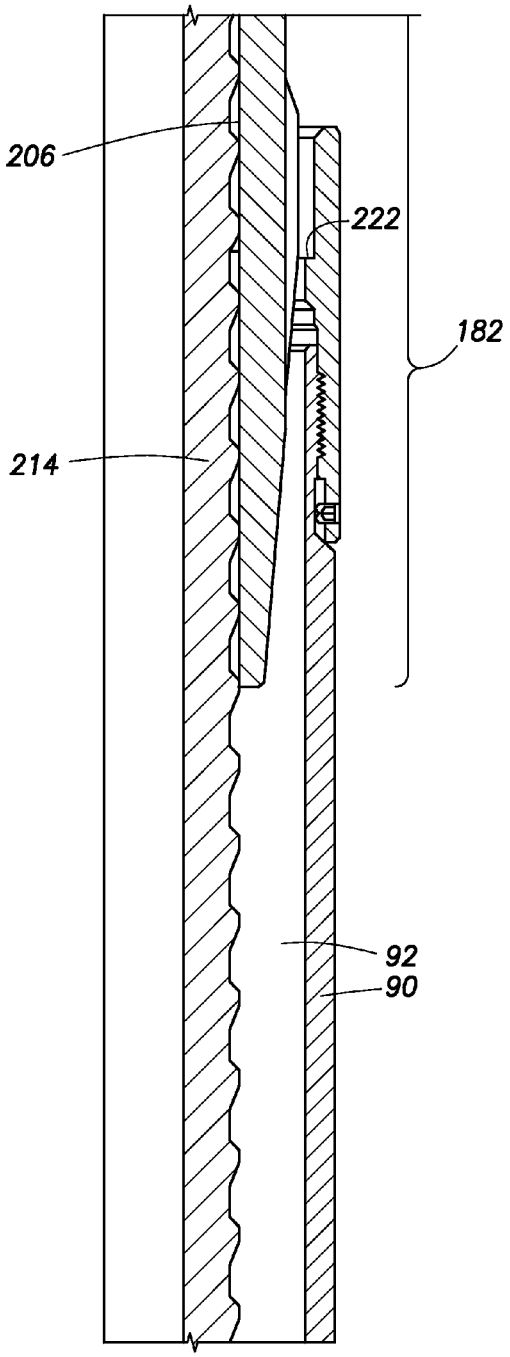
Figure 7E:
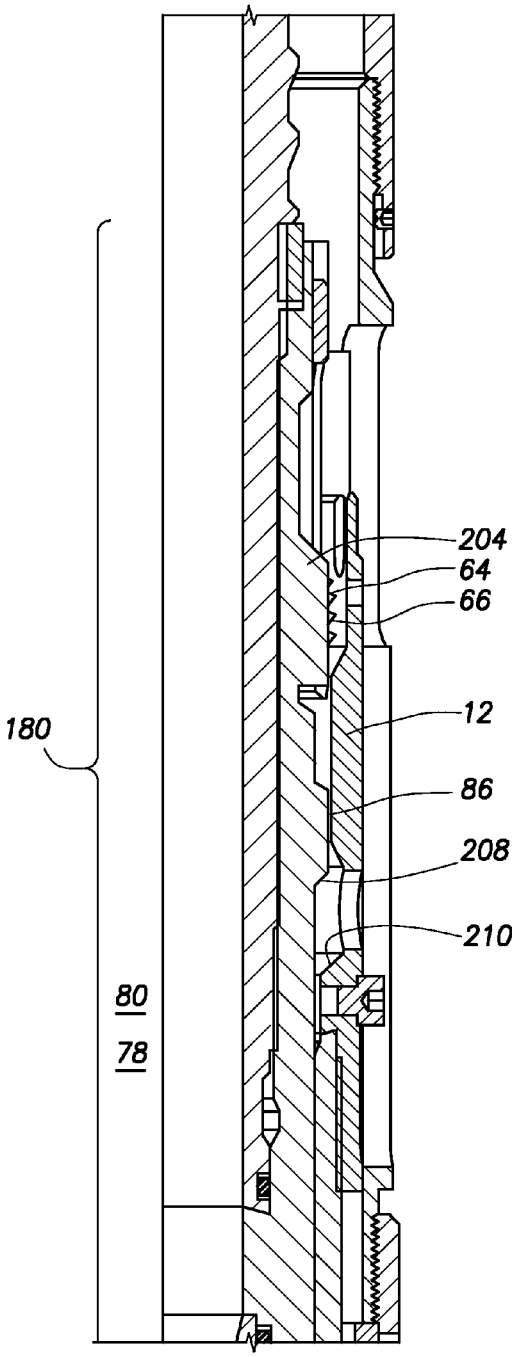
Figure 7F:
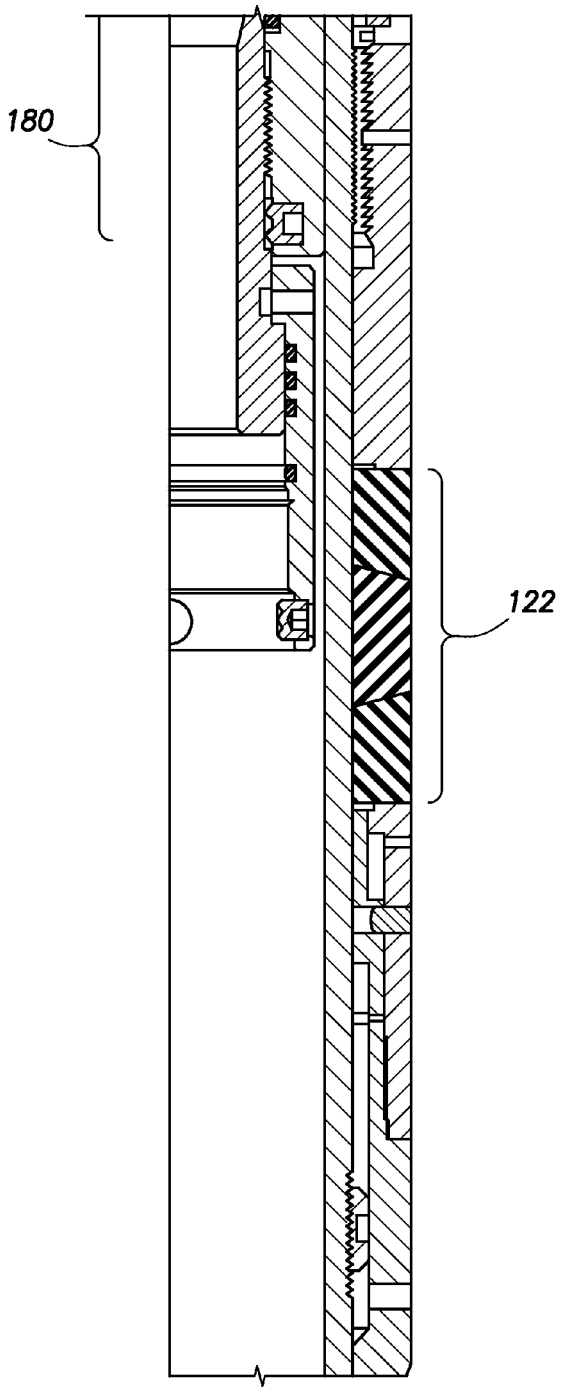
Figure 7G:
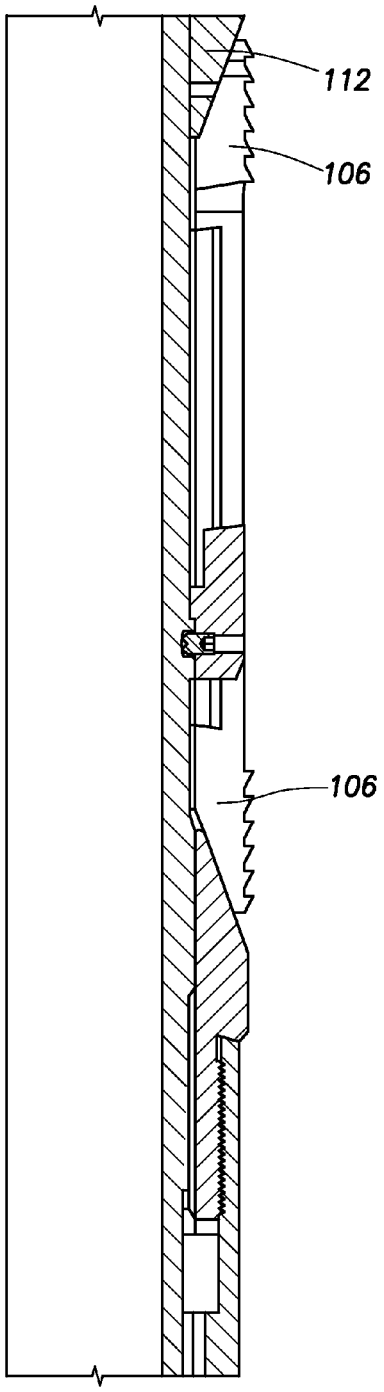
Figure 7H:
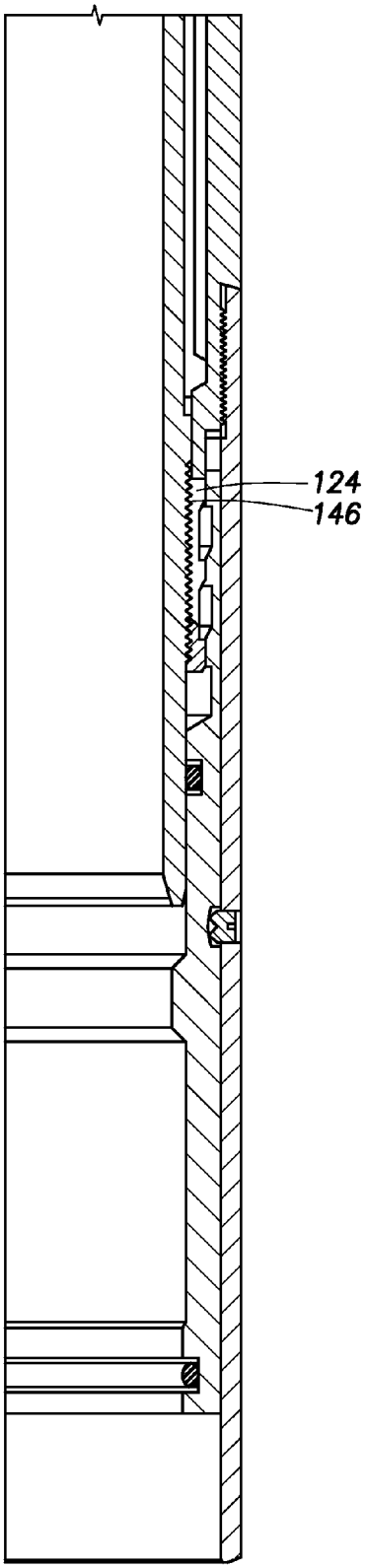

Slips 106 and 107 (FIG. 2G), of the type well known to those of ordinary skill in the art as "barrel" slips, are externally carried on the intermediate housing. The intermediate housing has radially inclined axially opposing ramp surfaces externally formed thereon for alternately urging the slips 106 and 107 radially outward to grippingly engage the wellbore 114 when the packer 76 is set therein, and retracting the slips 106 and 107 radially inward when the packer 76 is conveyed axially within the wellbore 114. As shown in FIG. 2G, the faces on the intermediate housing may be maintaining the slips 106 and 107 in their radially inwardly retracted positions. Note that other types of slips 106 and 107 may be utilized on the packer 76 without departing from the principles of the present device.

A generally tubular upper slip wedge 113 and lower slip wedge 121 (FIGS. 2G and 2H) may be axially slidingly carried externally on the intermediate housing. The upper slip wedge 113 and the lower slip wedge have, similar to the intermediate housing, radially inclined and axially opposing ramp surfaces (FIGS. 2G and 2H) formed thereon. The upper slip wedge 113 may be releasably secured against axial displacement relative to the intermediate housing by a series of circumferentially spaced apart shear pins installed radially through the upper slip wedge 113 and partially into the intermediate housing. When an axial downward force is applied on the package via the setting tool 200, the distance between the upper slip wedge 113 and the lower slip wedge 121 decreases and pushes the slips 106 and 107 radially outward to engage the wall of the wellbore 114 and/or a casing disposed within the wellbore 114.

A generally tubular upper element retainer 123*a* and a lower element retainer 123*b* (FIG. 2F) may be axially slidingly disposed externally on the intermediate housing. The upper and lower element retainers 123*a* and 123*b* axially straddle a set of seal elements 122 (FIG. 2F), with a backup shoe being disposed axially between the seal elements and each of the element retainers. A circumferential seal internally carried on the lower element retainer 123*b* may sealingly engage the intermediate housing.

The lower slip wedge 121 may be prevented from displacing axially downward on the intermediate housing by an end cap 124, which is threadedly attached the inner mandrel 78 at the threaded connection 146 and prevents downward movement of the intermediate housing. The threaded connection 146 is preferably a Vee thread profile, National profile, or similar thread profile connection. Alternatively, the lower housing 144 and inner mandrel 78 may be otherwise axially and sealingly attached without departing from the principles of the present device. Thus, when using the packer setting tool 200 to set the packer 76, the engagement between the male centralizer member shoulder 220 and the packer setting sleeve 90 may be capable of transmitting the required force to engage the packer setting elements, which may be applied to the packer by the packer setting piston 224. One advantage of the packer 76 is that it may be further set, so that the slips 106 and 107 increasingly grip the wellbore 114 and the seal elements 122 seal against the wellbore 114, by applying a force to set the packer using the packer setting tool 200. Thus, after the packer 76 has been installed in a wellbore 114 for an extended period of time, or if the packer 76 fails an initial pressure or pull test, and it is desired to further set the packer, the packer setting tool 200 may be engaged with the packer and a force applied to the packer to fully set the packer.

As disclosed in FIGS. 2A-2I, in order to set a packer 76 in the wellbore 114 after the packer 76 and the packer setting tool 200 are disposed in the wellbore 114, a centralizing member 212 disposed on the setting tool mandrel 202 may locate the packer 76 in the wellbore 114. The setting tool mandrel 202 with the centralizing member 212 may be guided into the packer setting sleeve 92. The centralizing member 212 may make contact with the packer setting sleeve 90 so that the curvature of the centralizing member 212 aligns the male centralizer member shoulder 220 for engagement with female packer setting sleeve shoulder 222. This feature of the centralizing member 212 may allow for the setting tool 200 to reset the packer 76 if the packer 76 was not initially set properly without having to remove the packer from the wellbore 114. The packer setting tool 200 may be driven into the setting sleeve 92 until the setting tool male no-go 208 engages the packer female no-go 210.

Looking at FIGS. 6A through 6I, when the packer setting tool 200 is driven through the setting sleeve 92 and approaches the packer female no-go 210, threads 62 on a latching member 204 may engage threads 86 on the top sub 12 of the packer 76. As previously described threads 62 and 86 are configured to move over each other as the packer setting tool 200 engages the packer 76 where the setting tool male no-go 208 and the packer female no-go 210 engage. Once the setting tool male no-go 208 and the packer female no-go 210 engage, the latching member 204 axially engages the packer 76 with the setting tool 200.

Turning to FIGS. 8A through 8I, after the setting tool 200 is axially engaged with packer 76, pressure may be applied on the packer setting tool 200 which opens a valve 240 permitting fluid communication between the central flow path 201 and the setting tool annular cavity 226 through the setting tool annular cavity opening 236. As fluid communicates through the setting tool annular cavity 226, a piston 224 may be energized, thereby driving a centralizing driving member 232 coupled to both the male centralizer member shoulder 220 and a slow stroke mandrel 214. The centralizing member 212 coupled with a collet 216 is engaged to circumferential mandrel grooves 206 disposed on the setting tool mandrel 202 such that when force is applied to the slow stroke mandrel 214, the slow stroke mandrel centralizing member 212 may incrementally move along with each member coupled with it. Thus, when the pressure builds in the setting tool annular cavity 226, the piston 224, the centralizing driving member 232, the male centralizer member shoulder 220, and centralizing member 212 may move incrementally in the direction towards the packer 76 until the male centralizer member shoulder 220 engages the female packer setting sleeve shoulder 222. This allows the setting tool 200 to set the packer 76 without damaging the packer by reduce or avoiding any hammering effect on the packer setting sleeve 90.

Looking now at FIGS. 9A through 9H, when the maximum pressure required to properly set the packer 76 is attained, a completion shear screw 234, which couples the centralizing driving member 232 with the male centralizer member shoulder 220, may shear so that force can longer be applied from the piston 224 to the packer 76. When the completion shear screw 234 shears, the drop in fluid pressure above the ball may notify the operator that the packer 76 is fully set. Once the packer 76 is fully set, the setting tool 200 may be rotated in a clockwise direction to unlatch the latching member 204 for the top sub 12 of the packer 76. The rotation of the setting tool 200 in the clockwise direction may prevent the rest of the tools within the wellbore 114 from loosening as they detached in a counter-clockwise direction. Once the latching member 204 de-latches from the packer 76, the setting tool 200 may be removed from the wellbore 114, as shown in FIGS. 7A through 7I. During removal, male shoulder 220 may disengage from the female shoulder 222. This disengagement may occur because the connection 252 retains the male shoulder 220 with the packer setting tool 200 as the packer setting tool 200 separates from the packer 76.

Of course, modifications may be made to the above described setting tool 200 or packer 76, by a person having ordinary skill in the art. For example, the shear screw 234 may be replaced with a force actuation mechanism configured to actuate in response to a threshold force. For example, a collet may be used in place of a shear screw, such that when the driving force reaches a threshold, the collet may be pushed into a recess allowing the male should 220 to move freely in the longitudinal direction. All such modifications are encompassed by the principles of the present device. Accordingly, the foregoing detailed description is to be clearly understood as being given by way of illustration and example only, the spirit and scope of the present device being limited solely by the appended claims.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_1$, and an upper limit, $R_u$, is disclosed, any number falling within the range is specifically disclosed. In particular, the following numbers within the range are specifically disclosed: $R=R_1+k*(R_u-R_i)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A setting tool comprising:

a centralizer section, wherein the centralizer section is configured to centralize a setting sleeve within a packer, and wherein the centralizer section is configured to control the rate at which the setting sleeve engages the packer;

a latching section configured to selectively engage the packer;

a setting section configured to provide a setting force to the packer through the setting sleeve;

a slow stroke mandrel comprising mandrel grooves; and a collet coupled to the centralizer section, wherein the collect is configured to engage the slow stroke mandrel, and wherein the selective engagement of the collet with the mandrel grooves is configured to control a stroke speed of the setting section.

2. The setting tool of claim 1, wherein the packer comprises a seal portion selectively operable to sealingly engage a wellbore.

3. The setting tool of claim 1, wherein the centralizer section comprises a centralizing member slidingly engaged about a setting tool mandrel.

4. The setting tool of claim 1, wherein the packer comprises a first threaded member, and wherein the latching section comprises a second threaded member configured to engage the first threaded member.

5. The setting tool of claim 4, wherein the second threaded member includes a series of circumferentially spaced apart and axially elongated fingers formed thereon.

6. The setting tool of claim 5, wherein the fingers are configured to be radially displaced in a manner permitting axial engagement of the first and second threaded members.

7. The setting tool of claim 1, wherein the packer portion has a bottom out surface formed thereon, and wherein the setting tool portion further comprises an abutment member slidingly disposed relative to the latching member, the abutment member being positioned to contact the bottom out surface before the latching section axially engages the first axial engagement surface.

8. The setting tool of claim 1, wherein the latching section releasably engages the setting tool portion to the packer portion.

9. The setting tool of claim 1, wherein the setting section comprises:

a piston; and a valve configured to selectively permit fluid communication through a cavity opening for applying pressure to drive the piston in an open configuration, wherein the piston is configure to apply a longitudinal force to the packer through the setting sleeve when the valve is in the open configuration.

10. A method for setting a packer in a wellbore, the method comprising:

positioning a setting tool in a wellbore adjacent a packer, wherein the packer comprises a packer setting sleeve, and wherein the setting tool comprises a setting sleeve disposed about a setting tool mandrel;

engaging the setting tool mandrel within the packer setting sleeve;

centralizing the setting tool mandrel within the packer setting sleeve;

incrementally driving the setting sleeve into engagement with the packer setting sleeve and controlling a stroke speed of the setting sleeve with a slow stroke mandrel comprising mandrel grooves and a collet engaging the mandrel grooves; and applying a setting force to the packer setting sleeve through the setting sleeve.

11. The method of claim 10, wherein the packer comprises a first threaded member, wherein the setting tool mandrel comprises a second threaded member, and wherein the step of engaging the setting tool mandrel with the packer setting sleeve comprises engaging the first threaded member with the second threaded member.

12. The method of claim 11, further comprising disengaging the setting tool from the packer, wherein disengaging the setting tool from the packer comprises disengaging the first threaded member from the second threaded member.

13. The method of claim 10, wherein incrementally driving the setting sleeve into engagement with the packer setting sleeve comprises controlling the stroke speed of the setting sleeve relative to the setting tool mandrel.

14. The method of claim 10, wherein engaging the setting tool mandrel with the packer setting sleeve comprises releasably engaging a latching member with the packer setting sleeve.

15. The method of claim 10, wherein the setting tool comprises a centralizing member slidingly disposed about the setting tool mandrel.

16. The method of claim 15, wherein centralizing the setting tool mandrel within the packer setting sleeve comprises extending the centralizing member into engagement with the packer setting sleeve.

17. The method of claim 10, wherein incrementally driving the setting sleeve into engagement with the packer setting sleeve comprises energizing a piston, and applying a driving force to the setting sleeve.

18. The method of claim 17, further comprising actuating a valve, and energizing the piston in response to actuating the valve.

19. The method of claim 10, further comprising forming a sealing engagement between the packer and the wellbore based on the applying of the setting force.

* * * * *